US009429860B2

(12) United States Patent
Kinumatsu et al.

(10) Patent No.: US 9,429,860 B2
(45) Date of Patent: Aug. 30, 2016

(54) TONER PRODUCTION METHOD

(71) Applicant: CANON KABUSHIKI KAISHA, Tokyo (JP)

(72) Inventors: Tetsuya Kinumatsu, Mishima (JP); Shuntaro Watanabe, Hadano (JP); Kenji Aoki, Mishima (JP); Atsushi Tani, Suntou-gun (JP); Yoshihiro Nakagawa, Numazu (JP); Takaaki Kaya, Suntou-gun (JP); Toshifumi Mori, Tokyo (JP); Yusuke Kosaki, Susono (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/283,923

(22) Filed: May 21, 2014

(65) Prior Publication Data

US 2014/0349232 A1 Nov. 27, 2014

(30) Foreign Application Priority Data

May 22, 2013 (JP) ..... 2013-108201

(51) Int. Cl.
*G03G 9/08* (2006.01)
*G03G 9/087* (2006.01)

(52) U.S. Cl.
CPC ..... *G03G 9/0804* (2013.01); *G03G 9/081* (2013.01); *G03G 9/0806* (2013.01); *G03G 9/08788* (2013.01); *G03G 9/08795* (2013.01); *G03G 9/08797* (2013.01)

(58) Field of Classification Search
CPC . G03G 9/0802; G03G 9/0804; G03G 9/0805; G03G 9/081; G03G 9/0815; G03G 9/0817
See application file for complete search history.

(56) References Cited

U.S. PATENT DOCUMENTS

| | | | |
|---|---|---|---|
| 6,569,589 | B2 | 5/2003 | Inaba et al. |
| 6,875,549 | B2 | 4/2005 | Yamazaki et al. |
| 7,820,354 | B2 | 10/2010 | Shirai |
| 8,178,275 | B2 | 5/2012 | Tani et al. |
| 8,425,815 | B2 | 4/2013 | Muratoglu et al. |
| 8,975,000 | B2 | 3/2015 | Tani et al. |

(Continued)

FOREIGN PATENT DOCUMENTS

| | | | |
|---|---|---|---|
| JP | 2005-308995 | A | 11/2005 |
| JP | 2006-65015 | A | 3/2006 |

(Continued)

*Primary Examiner* — Peter Vajda
(74) *Attorney, Agent, or Firm* — Fitzpatrick, Cella, Harper & Scinto

(57) ABSTRACT

A method for producing a toner that comprises toner particles, each of which comprises a binder resin, which comprises a resin (A) capable of forming a crystalline structure, and a colorant, the method including: a pressure holding step of, after preparing toner particles, holding the toner particles for 5 minutes or more at a pressure of 2.0 MPa or more under conditions of a temperature T1 (° C.) represented by formula (1):

$$20 \leq T1 \leq Tp2 \quad (1)$$

(wherein, Tp2 represents the onset temperature of the maximum endothermic peak derived from the resin (A)), wherein a peak temperature Tp1 of the maximum endothermic peak derived from the resin (A) during the first temperature rise of the toner particles as determined by differential scanning calorimetric measurement is 50° C. to 90° C.

6 Claims, 3 Drawing Sheets

(56) References Cited

U.S. PATENT DOCUMENTS

| | | | | |
|---|---|---|---|---|
| 2008/0261137 | A1* | 10/2008 | Qin et al. | 430/108.3 |
| 2012/0021348 | A1* | 1/2012 | Kaya et al. | 430/109.4 |
| 2013/0130169 | A1 | 5/2013 | Aoki et al. | |
| 2015/0261110 | A1 | 9/2015 | Nakagawa et al. | |

FOREIGN PATENT DOCUMENTS

| | | | |
|---|---|---|---|
| JP | 2009-504897 | A | 2/2009 |
| JP | 2012-42939 | A | 3/2012 |

* cited by examiner

TONER PRODUCTION METHOD

BACKGROUND OF THE INVENTION

1. Field of the Invention

The present invention relates to a method for producing a toner used in recording methods using electrophotography, electrostatic recording and toner jet recording.

2. Description of the Related Art

Energy savings have recently come to be considered as an important issue confronting electrophotographic devices, and significant reductions in the amount of heat required by fixing apparatuses are being examined. Thus, there is a growing demand for toner to be able to be fixed with less energy, or in other words, demonstrate "low-temperature fixability". One example of a technique for enabling fixation at low temperatures involves lowering the glass transition temperature (Tg) of the binder resin present in the toner. However, since lowering Tg leads to a loss of toner heat-resistant storability, it is considered to be difficult for this technique to simultaneously realize both toner low-temperature fixability and heat-resistant storability.

Attention has particularly been focused in recent years on crystalline resins for use as binder resin materials for enabling simultaneous realization of both low-temperature fixability and heat-resistant storability. Crystalline resins are able to form a structure in which molecular chains composing the resin are arranged in an orderly manner, and are known to have a melting point (Tm) without demonstrating a well-defined Tg. Consequently, they are resistant to softening at temperatures below the crystal melting point, and have the property of demonstrating a sudden decrease in viscosity when the crystals melt after reaching the melting point (sharp melt property).

On the basis thereof, studies have been extensively conducted on toners obtained by adding a crystalline resin to an amorphous binder resin.

However, since crystalline resins are composed of polymeric substances having a certain degree of molecular weight distribution in the same manner as typical resin materials, they are not always able to form a completely ordered structure. Moreover, in the case of using such resins as toner materials, since steps are required in an ordinary toner production process in which thermal hysteresis is applied at a temperature equal to or higher than the melting point or the toner is dissolved in an organic solvent together with other materials, crystalline resins become compatible with amorphous resins resulting in increased susceptibility to the loss of crystallinity. Thus, it is not easy to allow a crystalline resin to be present in a toner while retaining the crystallinity thereof, and normally easily adopts a form consisting of a mixture of portions of high crystallinity and portions of low crystallinity. As a result, there are many cases in which crystalline resins do not demonstrate their inherent "sharp melt property" even if added to toner, while also demonstrating a decrease in heat-resistant storability.

In addition, toners containing components of low crystallinity and low molecular weight components formed as a result of compatibility end up undergoing further decreases in crystallinity due to the effects of these components in the case of allowing to stand for long periods of time. As a result thereof, changes occur in the thermal properties of the toner, thereby causing further decreases in low-temperature fixability and heat-resistant storability.

In order to solve such problems, toner intermediates or toner containing crystalline resin that has decreased in crystallinity is subjected to heat treatment at a temperature lower than the melting point of the crystalline resin in an attempt to reassemble crystalline structure. As a result of polymer chains present in crystalline resins being retained at high temperatures, molecular mobility increases making it easier to form a crystalline structure having a more stable structure. However, in the case of holding at a temperature higher than the melting point, energy ends up being applied that is equal to or greater than the intermolecular force required to maintain crystalline structure, and the crystalline structure ends up collapsing.

For example, Japanese Patent Application Laid-open No. 2006-065015 proposes a toner production method comprising a step in which an intermediate or finished product of a toner production step containing a crystalline polyester and amorphous polyester as binder resins is stored at a temperature of 45° C. to 65° C. According to this method, a compatible portion at the domain interface between the crystalline polyester and amorphous polyester is crystallized. However, in addition to crystallization requiring a long period of time, due to the large difference between the melting point and storage temperature of the crystalline polyester, the effect thereof is not necessarily adequate.

In addition, Japanese Patent Application Laid-open No. 2005-308995 proposes a toner production method comprising melting and kneading a raw material containing a crystalline polyester and an amorphous polyester, followed by carrying out heat treatment, under conditions of a temperature equal to or higher than the glass transition temperature of the molten mixture and 10° C. lower than the softening point of the amorphous polyester, and pulverizing. However, the object of this method is to raise the Tg of the amorphous polyester, and was insufficient for obtaining crystalline polyester having a sharp melt property.

Japanese Patent Application Laid-open No. 2012-042939 proposes a toner production method that involves heating and holding a toner composition containing a crystalline polyester at a temperature (T1) that is 20° C. to 5° C. lower than the peak temperature of the maximum endothermic peak as determined by differential scanning calorimetric (DSC) measurement (namely, the melting point), followed by heating and holding at a temperature (T2) that is 10° C. to 2° C. lower than the peak temperature of the maximum endothermic peak as determined by DSC measurement of the heated toner composition. In this method, although heat-resistant storability and low-temperature fixability of the toner can be improved, in addition to requiring heating for a long period of time, the number of steps increases and the procedure is complex.

On the other hand, Japanese Translation of PCT Application No. 2009-504897 proposes a technology for crystallizing a molten polyethylene resin by holding in a high-pressure environment followed by cooling. According to this method, differing from the lamellar structure attributable to typical polymer chain folding, an extended chain crystalline structure is described as being adopted in which polymer chains are fully extended. This crystallization demonstrates a higher degree of crystallinity than ordinary crystallization at atmospheric pressure. However, the use of a crystallization technique requiring melting was difficult to apply to granules in the manner of toner in terms of maintaining the particle state of the toner.

As has been described above, production methods for adequately demonstrating the inherent performance of crystalline resin and sustaining stable low-temperature fixability and heat-resistant storability of toner over a long period of time continue to have problems.

SUMMARY OF THE INVENTION

The present invention provides a toner production method that solves the above-mentioned problems of the related art.

Namely, the present invention provides a production method that enables a toner to be easily obtained that has superior heat-resistant storability despite having superior low-temperature fixability, and is able to stably sustain that performance even when stored for a long period of time.

The present invention relates to a toner production method, comprising:

a step of preparing untreated toner particles, each of which comprises a binder resin and a colorant, the binder resin containing a resin (A) capable of forming a crystalline structure; and a pressure treatment step of obtaining treated toner particles by holding the untreated toner particles for 5 minutes or more in a state in which pressure of 2.0 MPa or more is applied to the untreated toner particles under conditions of a temperature T1 (° C.) defined by formula (1):

$$20 \leq T1 \leq Tp2 \quad (1)$$

(wherein, Tp2 represents an onset temperature (° C.) of the maximum endothermic peak derived from the resin (A) on an endothermic curve during a first temperature rise of the untreated toner particles as determined by differential scanning calorimetric measurement), wherein a peak temperature Tp1 of the maximum endothermic peak derived from the resin (A) on the endothermic curve during the first temperature rise of the untreated toner particles as determined by differential scanning calorimetric measurement is at least 50° C. and not more than 90° C.

According to the present invention, a production method can be provided that enables a toner to be easily obtained that has superior heat-resistant storability despite having superior low-temperature fixability, and is able to stably sustain that performance even when stored for a long period of time.

Further features of the present invention will become apparent from the following description of exemplary embodiments (with reference to the attached drawings).

DESCRIPTION OF THE PREFERRED EMBODIMENTS

Figure 1:
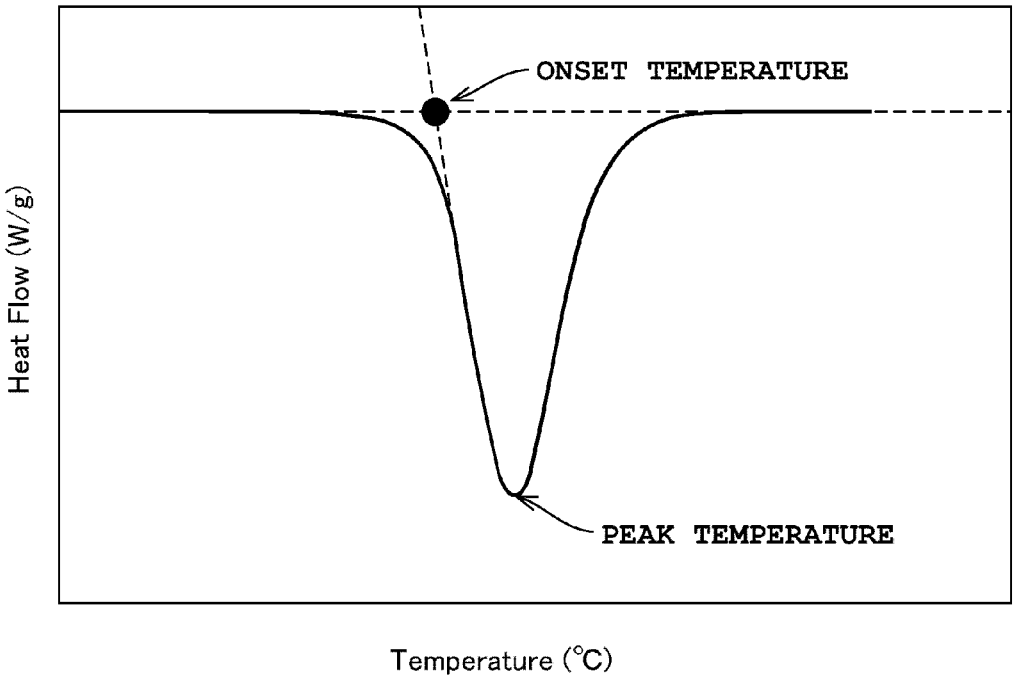
FIG. 1 is a drawing indicating the onset temperature of an endothermic peak observed during the heating process in differential scanning calorimetric measurement.

Although the following provides a more detailed explanation of the present invention by indicating preferred embodiments thereof, the present invention is not limited to these embodiments.

The resin binder used in the toner production method of the present invention comprises a toner (A) capable of forming a crystalline structure. A toner capable of forming a crystalline structure refers to a resin that demonstrates crystallinity as a result of the polymer chains composing the resin arranging in an orderly manner when a large number thereof have aggregated. A resin capable of forming a crystalline structure is hereinafter simply referred to as a "crystalline resin". In order to effectively use a crystalline resin as a toner material, it is important to not only simply control the amount of crystalline resin contained in the toner particles, but also properly control the degree of crystallinity of the resin per se. As was previously described, an effective method for controlling the crystallinity of a crystalline resin involves carrying out heat treatment on toner particles containing the crystalline resin at a temperature lower than the melting point of the crystalline resin.

In the subsequent descriptions, this heat treatment is referred to as "annealing treatment", and this heat treatment step is referred to as an "annealing treatment step".

The above-mentioned annealing treatment is required to be carried out at a suitable temperature and for a suitable amount of time. If the treatment temperature is excessively low or the treatment time is excessively short, crystallization becomes inadequate, and toner produced by undergoing such an annealing treatment step is not only unable to obtain adequate improvement effects on low-temperature fixability and heat-resistant storability, but also undergoes a further decrease in performance due to changes in the crystal state when stored fora long period of time.

Furthermore, the degree of crystallization of a crystalline resin contained in toner particles can be roughly determined from the shape and half-width value of the maximum endothermic peak derived from the crystalline resin as depicted by differential scanning calorimetric (DSC) measurement of the toner composition. Namely, the shape of the peak becomes increasingly sharp and the half-width value becomes narrower the higher the degree of crystallinity.

The inventors of the present invention conducted a study of the effects of treatment temperature and treatment time during annealing treatment on toner particles along with the effects of treatment pressure. As a result, in an environment subjected to a certain pressure or higher, it was found that the crystallinity of a resin can be increased at a lower temperature and in a shorter period of time in comparison with a conventional normal pressure environment without significantly causing the resin to melt.

A toner that has undergone such a step allows the obtaining of effects equal to or better than improvement effects on low-temperature fixability and heat-resistant storability attributable to conventional annealing treatment at normal pressure, while also enables those effects to be stably sustained, thereby leading to completion of the present invention.

More specifically, the toner production method of the present invention (to also be simply referred to as the "production method of the present invention") is characterized as a toner production method, comprising:

(i) a step of preparing untreated toner particles, each of which comprises a binder resin, which comprises a resin (A) capable of forming a crystalline structure, and a colorant; and (ii) a pressure treatment step of obtaining treated toner by holding the untreated toner particles for 5 minutes or more in a state in which pressure of 2.0 MPa or more is applied to the untreated toner particles under conditions of a temperature T1 (° C.) defined by formula (1):

$$20 \leq T1 \leq Tp2 \quad (1)$$

(wherein, Tp2 represents the onset temperature (° C.) of the maximum endothermic peak derived from the resin (A) on an endothermic curve during the first temperature rise of the untreated toner particles as determined by differential scanning calorimetric measurement), wherein a peak temperature Tp1 of the maximum endothermic peak derived from the resin (A) on an endothermic curve during the first temperature rise of the untreated toner particles as determined by differential scanning calorimetric measurement is from at least 50° C. to not more than 90° C. A peak temperature Tp1 of the maximum endothermic peak derived from the resin (A) during the first temperature rise of the untreated toner particles prior to undergoing pressure treatment to be subsequently described as determined by differential scanning calorimetric measurement appears at from at least 50° C. to not more than 90° C.

In the case the above-mentioned Tp1 is lower than 50° C., although effects are demonstrated on low-temperature fixability, it is difficult to obtain adequate heat-resistant storability even if the above-mentioned annealing treatment is carried out, and may lead to the occurrence of aggregation of toner particles in the case of having been stored in a high-temperature environment. On the other hand, in the case the above-mentioned Tp1 exceeds 90° C., although heat-resistant storability is superior, the toner particles lack low-temperature fixability, allowing them to only be fixed at high temperatures. Namely, both low-temperature fixability and heat-resistant storability can be realized by making the above-mentioned Tp1 to be within the range of 50° C. to 90° C. The above-mentioned Tp1 is preferably 55° C. or higher. In addition, it is preferably 80° C. or lower.

Furthermore, the above-mentioned Tp1 can be adjusted to be within the above-mentioned range by altering the types and combinations of polymerizable monomers serving as constituents of those segments capable of forming a crystalline structure in the resin (A) capable of forming a crystalline structure.

In the production method of the present invention, after having a prepared untreated toner particles, the untreated toner particles are held in a pressurized state under the conditions of temperature T1 (° C.) represented by the following formula (1).

$$20 \leq T1 \leq Tp2 \quad (1)$$

Here, Tp2 (° C.) represents the onset temperature of the maximum endothermic peak derived from the above-mentioned resin (A) on an endothermic curve during the first temperature rise of the untreated toner particles as determined by differential scanning calorimetric (DSC) measurement. As shown in FIG. 1, the onset temperature Tp2 is the temperature that indicates the intersection of a straight line obtained by extending the baseline on the low temperature side of the peak in the DSC chart towards the high temperature side, and a straight line drawn along the curve indicating the start of heat absorption during heating at the point of the maximum slope thereof. This temperature is considered to be the temperature at which the crystalline structure of the above-mentioned resin (A) begins to collapse. Furthermore, in the production method of the present invention, the onset temperature Tp2 is automatically calculated by analytical software provided with the differential scanning calorimetric measurement device to be subsequently described.

In the case of controlling temperature at the temperature T1 (° C.) that is equal to or lower than the temperature Tp2 (° C.), crystallization is thought to be able to be promoted by activating the movement of only the polymer chains of portions of low crystallinity without collapsing the crystalline structure of portions of high crystallinity. In the case T1 exceeds Tp2, collapse of the crystalline structure of portions of high crystallinity begins and the ratio of portions of low crystallinity increases. As a result, heat-resistant storability becomes poor and there is increased susceptibility to the occurrence of aggregation of toner particles in the case of having been placed in a high-temperature environment. With respect to the lower limit of T1, although crystallization proceeds even in the case T1 is below 20° C. provided sufficient pressure is applied, the lower limit thereof is 20° C. or higher in consideration of industrial significance from the viewpoints of cooling costs and the amount of time required for treatment.

In order to improve crystallinity even more effectively, T1 is preferably 25° C. or higher and more preferably 30° C. or higher.

In the production method of the present invention, after preparing untreated toner particles, the toner particles are subjected to pressurized annealing treatment at a pressure of 2.0 MPa or higher under conditions of the temperature T1 (° C.) represented by the above-mentioned formula (1) to obtain treated toner particles. As a result of carrying out pressurized annealing treatment at a pressure of 2.0 MPa or higher, the crystallinity of portions of low crystallinity can be enhanced and heat-resistant storability improves. In the case the pressure is below 2.0 MPa, the effect of forming a crystalline structure by pressurization decreases, and the effect of annealing treatment is inadequate. In order to improve crystallinity more effectively, pressurized annealing treatment is preferably carried out at a pressure of 5.0 MPa or higher and more preferably at a pressure of 8.0 MPa or higher. Although there are no particular technical restrictions on the upper limit of pressure, the upper limit is preferably 50.0 MPa or lower and more preferably 20.0 MPa or lower based on the ease of designing the pressure-resistant vessel and pressurization means required for treatment.

In the production method of the present invention, pressurized annealing treatment is carried out for 5 minutes or more after having prepared the toner particles. As a result of carrying out pressurized annealing treatment for 5 minutes or more, an adequate amount of time for enhancing the crystallinity of portions of low crystallinity can be imparted, thereby leading to improvement of heat-resistant storability. In the case the duration of pressurized annealing treatment is less than 5 minutes, the amount of time required to form a crystalline structure is thought to be insufficient, and the effect of improving heat-resistant storability is no longer adequate. In order to further increase portions of high crystallinity, pressurized annealing treatment is preferably carried out for 10 minutes or more and more preferably for 30 minutes or more. Although there are no particular technical restrictions on the upper limit of the duration of the above-mentioned pressurized annealing treatment, in consideration of industrial significance from the viewpoints of effects obtained when held for a certain amount of time or longer and treatment costs required therefor, the upper limit is preferably 480 minutes or less and preferably 240 minutes or less.

The production method of the present invention is preferably carried out in a medium obtained by compressing a medium in a gaseous or liquid state at atmospheric pressure and within a temperature range of 0° C. to 90° C. In particular, the method is preferably carried out in a medium having carbon dioxide as a main component. The term "having as a main component" refers to the ratio of carbon dioxide in the medium being 50 mass % or more, preferably 80 mass % or more, and even more preferably 95 mass % or more. In addition, the above-mentioned carbon dioxide is preferably in a liquid state and more preferably in a supercritical state.

Here, liquid carbon dioxide refers to carbon dioxide under temperature and pressure conditions of the portion surrounded by the gas/liquid boundary line that passes through the triple point (temperature=−57° C., pressure=0.5 MPa) and critical point (temperature=31° C., pressure=7.4 MPa) in a phase diagram of carbon dioxide, the isotherm of the critical temperature, and the solid/liquid boundary line. In addition, carbon dioxide in a supercritical state refers to carbon dioxide under temperature and pressure conditions equal to or higher than the critical point of carbon dioxide.

Figure 2:
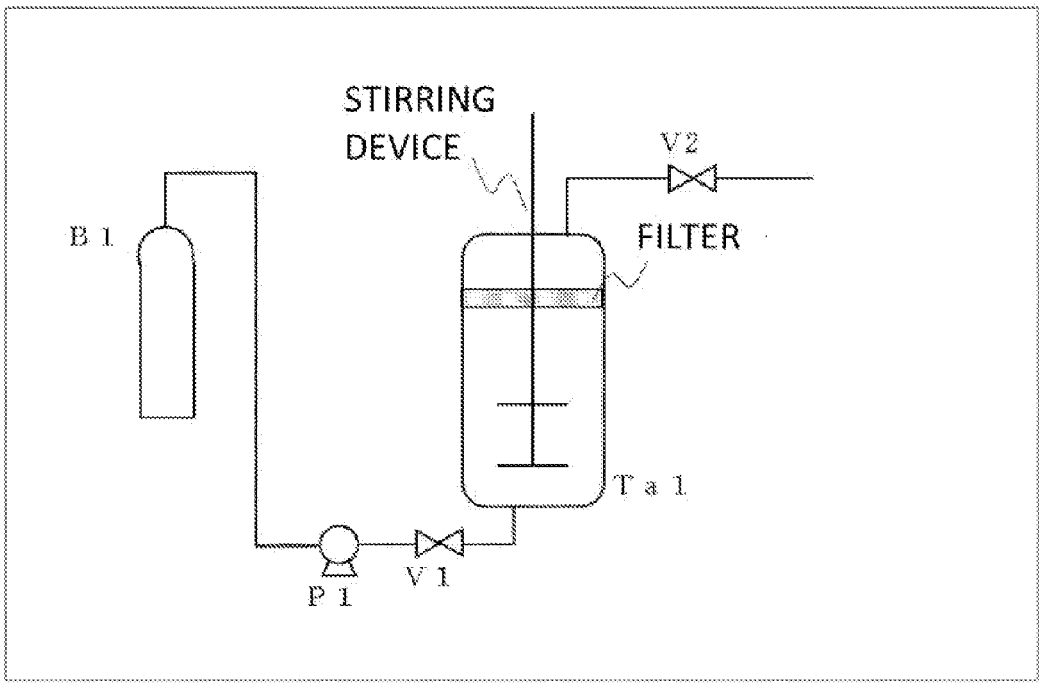
FIG. 2 is a schematic diagram showing an example of a pressure holding device.

Although there are no particular limitations on the pressure holding device used in pressurized annealing treatment in the production method of the present invention provided it can be adjusted to a prescribed pressure and temperature, the following provides an explanation of the production method of the present invention based on the example of a treatment device shown in FIG. 2.

A pressure holding tank Ta1 of the treatment device shown in FIG. 2 is provided with filter to prevent toner particles following pressurization annealing treatment from flowing outside the tank Ta1 together with medium when discharging medium to the outside through a pressure regulating valve V2, and has a stirring mechanism for mixing.

Pressure annealing treatment is carried out by first placing untreated toner particles in the tank Ta1 controlled to a temperature T1 (° C.) followed by stirring. Next, a valve V1 is opened, medium that has been compressed using a compression pump P1 is introduced into the tank Ta1 from a container B1 in which medium is stored, and pressure inside the tank Ta1 is raised to a prescribed pressure. Once the pressure has reached the prescribed pressure, the pump is stopped, the valve V1 is closed and the pressure is held at the prescribed pressure for 5 minutes or more. After a prescribed retention time has elapsed, the valve V2 is opened, medium is discharged outside the tank Ta1, and pressure inside the tank Ta1 is reduced to atmospheric pressure. Treated toner particles that have undergone the production steps of the production invention are obtained by going through these steps.

In the present invention, the above-mentioned resin (A) is preferably a resin comprising segments capable of forming a crystalline structure. In addition, the content of those segments capable of forming a crystalline structure is preferably 30.0 mass % or more based on the total mass of the binder resin. As a result of making the content of segments capable of forming a crystalline structure to be 30.0 mass % or more based on the total mass of the binder resin, a sharp melt property is adequately demonstrated during fixation and low-temperature fixability improves. In order to obtain an even greater low-temperature fixability effect, the content of segments capable of forming a crystalline structure is more preferably 50.0 mass % or more, and even more preferably 70.0 mass % or more, based on the total mass of the binder resin.

Although there are no particular limitations on the form of the segments capable of forming a crystalline structure contained in the resin (A), examples thereof include polyester resin and vinyl resin obtained by polymerizing a monomer capable of forming a crystalline structure during polymerization.

A polyester resin capable of forming a crystalline structure (to also be referred to as crystalline polyester) refers to polyester that demonstrates a well-defined melting point peak as determined by differential scanning calorimetric (DSC) measurement.

The crystalline polyester is preferably obtained by reacting an aliphatic diol having 2 to 20 carbon atoms with a polyvalent carboxylic acid having 2 to 20 carbon atoms, and is more preferably obtained by reacting an aliphatic diol having 2 to 20 carbon atoms with an aliphatic dicarboxylic acid having 2 to 20 carbon atoms.

In addition, the aliphatic diol is preferably of the linear chain type. As a result of being of the linear chain type, polyester is obtained that has a higher degree of crystallinity.

Examples of linear chain type aliphatic diols having 2 to 20 carbon atoms include the compounds indicated below:

1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol.

Among these, 1,2-ethanediol, 1,4-butanediol, 1,5-petanediol and 1,6-hexanediol are more preferable from the viewpoint of melting point. These may be used alone or two or more types can be used as a mixture.

In addition, aliphatic diols having a double bond can also be used. Examples of aliphatic diols having a double bond include the following compounds: 2-butene-1,4-diol, 3-hexene-1,6-diol and 4-octene-1,8-diol.

In addition, the above-mentioned polyvalent carboxylic acid is preferably an aromatic dicarboxylic acid or aliphatic dicarboxylic acid, and among these, an aliphatic dicarboxylic acid is more preferable, while a linear chain type of aliphatic dicarboxylic acid is particularly preferable from the viewpoint of crystallinity.

Examples of the above-mentioned aliphatic dicarboxylic acid include the compounds indicated below:

oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and lower alkyl esters and acid anhydrides thereof.

Among these, sebacic acid, adipic acid, 1,10-decanedicarboxylic acid and lower alkyl esters and acid anhydrides thereof are preferable.

Examples of aromatic dicarboxylic acids include the following compounds: terephthalic acid, isophthalic acid, 2,6-naphthalenedicarboxylic acid and 4,4'-biphenyldicarboxylic acid. Among these, terephthalic acid is preferable from the viewpoints of availability and ease of forming polymers having a low melting point. These may be used alone or two or more types can be used as a mixture.

In addition, a dicarboxylic acid having a double bond can also be used. A dicarboxylic acid having a double bond can be used preferably to prevent hot offset during fixation since the entire resin can be crosslinked by utilizing that double bond.

Examples of such dicarboxylic acids include fumaric acid, maleic acid, 3-hexenedioic acid and 3-octenedioic acid. In addition, examples also include lower alkyl esters and acid anhydrides thereof. Among these, fumaric acid and maleic acid are more preferable in terms of cost.

There are no particular limitations on the method used to produce crystalline polyester, and can be produced by polymerizing a typical polyester resin obtained by reacting an acid component and an alcohol component. For example, a direct polycondensation method or transesterification method can be used, and these methods can be used according to the type of monomer.

Production of crystalline polyester is preferably carried out between polymerization temperatures of 180° C. to 230° C., pressure inside the reaction system may be reduced as necessary, and the reaction is preferably carried out while removing water and alcohol generated during condensation. In the case the monomer does not dissolve or is not compatible at the reaction temperature, the monomer is preferably dissolved by using a high boiling point solvent as a solubilizing agent. The polycondensation reaction is carried out while removing the solubilizing agent. In the case a resin having poor compatibility is present in the polymerization reaction, the monomer having poor compatibility is preferably condensed in advance with the acid or alcohol scheduled to be polycondensed with that monomer followed by polycondensing with the main component.

Examples of catalysts that can be used during production of the crystalline polyester include the following compounds:

titanium catalysts in the manner of titanium tetraethoxide, titanium tetrapropoxide, titanium tetraisopropoxide and titanium tetrabutoxide, and tin catalysts in the manner of dibutyltin dichloride, dibutyltin oxide and diphenyltin oxide.

Examples of vinyl resins able to form a crystalline structure (to be referred to as crystalline vinyl resins) include resins obtained by polymerizing a vinyl monomer containing a linear chain type of alkyl group in the molecular structure thereof.

The vinyl monomer containing a linear chain type of alkyl group in the molecular structure thereof is preferably an alkyl acrylate or alkyl methacrylate in which the number of carbon atoms of the alkyl group is 12 or more, and examples thereof include the following compounds: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate and behenyl methacrylate.

In the production method of a crystalline vinyl resin, polymerization is preferably carried out at a temperature of 40° C. or higher, typically 50° C. to 90° C.

Segments incapable of forming a crystalline structure in the form of amorphous resin can be contained in the above-mentioned resin (A) in addition to segments capable of forming a crystalline structure. As a result of containing amorphous resin, toner elasticity is easily maintained in the temperature range during which fixation occurs after melting at a sharp melting point.

There are no particular limitations on the amorphous resin provided it does not demonstrate a well-defined maximum endothermic peak during differential scanning calorimetric measurement, and amorphous resins similar to those commonly used as toner resins can be used. However, the glass transition temperature (Tg) of the amorphous resin is preferably 50° C. to 130° C. and more preferably 70° C. to 130° C.

Specific examples of amorphous resins include amorphous polyester resin, polyurethane resin and vinyl resin. In addition, these resins may be modified with urethane, urea or epoxy. Among these, amorphous polyester resin and polyurethane resin are preferable examples from the viewpoint of maintaining elasticity.

The following provides a detailed description of amorphous polyester resin. Examples of monomers able to be used to produce amorphous polyester resins include conventionally known carboxylic acids having a valence of two or more and alcohols having a valence of two or more as described in, for example, "The Polymer Data Handbook: Basic Edition", pages 258-326, (Society of Polymer Science, Japan, ed., Baifukan Co., Ltd.). Specific examples of these monomers include those indicated below.

Examples of divalent carboxylic acids include the following compounds: dibasic acids in the manner of succinic acid, adipic acid, sebacic acid, phthalic acid, isophthalic acid, terephthalic acid, malonic acid and dodecenylsuccinic acid along with anhydrides and lower alkyl esters thereof, and aliphatic unsaturated carboxylic acids in the manner of maleic acid, fumaric acid, itaconic acid and citraconic acid.

In addition, examples of carboxylic acids having a valence of three or more include the following compounds: 1,2,4-benzenetricarboxylic acid, 1,2,5-benzenetricarboxylic acid and anhydrides and lower alkyl esters thereof. One type of these may be used alone or two or more types may be used in combination.

Examples of divalent alcohols include the following compounds: bisphenol A, hydrogenate bisphenol A, ethylene oxide and propylene oxide adducts of bisphenol A, 1,4-cyclohexanediol, 1,4-cyclohexanedimethanol, ethylene glycol and propylene glycol.

In addition, examples of alcohols having a valence of three or more include the following compounds: glycerin, trimethylolethane, trimethylolpropane and pentaerythritol. One type of these may be used alone or two or more types may be used in combination.

Furthermore, a monovalent acid such as acetic acid or benzoic acid, or a monovalent alcohol such as cyclohexanol or benzyl alcohol, can also be used as necessary for the purpose of adjusting acid value or hydroxyl value.

Amorphous polyester resin can be synthesized using a method described in, for example, Polycondensation, pages 17-43, (Kagaku Dojin Co., Ltd.), Polymer Experimentation, pages 248-275, (Polycondensation and Polyaddition, Kyoritsu Shuppan Co., Ltd.) or Polyester Resin Handbook, page 45-49, (Nikkan Kogyou Shimbun, Ltd.). In addition, transesterification and direct polycondensation can be used alone or in combination.

Next, a description is provided of amorphous polyurethane resin. Polyurethane resin is the reaction product of a diol and a substance containing a diisocyanate group, and resins having various types of functionality can be obtained by adjusting the diol and diisocyanate.

Examples of diisocyanate compounds include the following: aromatic diisocyanates having 6 to 20 carbon atoms (excluding the carbon atom in the NCO group, and to apply similarly hereinafter), aliphatic diisocyanates having 2 to 18 carbon atoms, alicyclic diisocyanates having 4 to 15 carbon atoms, modified forms of these diisocyanates (modified forms containing a urethane group, carbodiimide group, allophanate group, urea group, biuret group, uretodione group, uretoimine group, isocyanurate group or oxazolidone group (to be referred to as "modified diisocyanates")), and mixtures of two or more types thereof.

Examples of aromatic diisocyanates include the following: m- and/or p-xylylene diisocyanate (XDI) and $\alpha,\alpha,\alpha',\alpha'$-tetramethylxylylene diisocyanate.

In addition, examples of aliphatic diisocyanates include the following: ethylene diisocyanate, tetramethylene diisocyanate, hexamethylene diisocyanate (HDI) and dodecamethylene diisocyanate.

In addition, examples of alicyclic diisocyanates include the following: isophorone diisocyanate (IPDI), dicyclohexylmethane-4,4'-diisocyanate, cyclohexylene diisocyanate and methylcyclohexylene diisocyanate.

These diisocyanates are preferably aromatic diisocyanates having 6 to 15 carbon atoms, aliphatic diisocyanates having 4 to 12 carbon atoms or alicyclic diisocyanates having 4 to 15 carbon atoms, and particularly preferably XDI, IPDI and HDI.

In addition, isocyanato compounds having three or more functional groups in addition to a diisocyanate component are able to be used in polyurethane resins.

Examples of diol components able to be used in polyurethane resins include the following: alkylene glycols (such as ethylene glycol, 1,2-propylene glycol or 1,3-propylene glycol), alkylene ether glycols (such as polyethylene glycol or polypropylene glycol), alicyclic diols (such as 1,4-cyclohexanedimethanol), bisphenols (such as bisphenol A), and alkylene oxide adducts of alicyclic diols (such as ethylene oxide or propylene oxide).

The alkyl moiety of alkylene glycols and alkylene ether glycols may be linear or branched. Alkylene glycols having a branched structure can also be used preferably in the present invention.

The following provides a description of amorphous vinyl resin. Examples of monomers able to be used in the production of amorphous vinyl resin include the compounds indicated below:

aliphatic vinyl hydrocarbons: alkenes (such as ethylene, propylene, butene, isobutylene, pentene, heptene, diisobutylene, octene, dodecene, octadecene or α-olefins other than those previously described) and alkadienes (such as butadiene, isoprene, 1,4-pentadiene, 1,6-hexadiene or 1,7-octadiene);

alicyclic vinyl hydrocarbons: mono- or dicycloalkenes and alkadienes (such as cyclohexene, cyclopentadiene, vinylcyclohexene, ethylidene bicycloheptene), and terpenes (such as pinene, limonene or indene);

aromatic vinyl hydrocarbons: styrene and hydrocarbyl substituted forms thereof (including alkyl-, cycloalkyl-, aralkyl- and/or alkenyl-substituted forms) (such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene or trivinylbenzene), and vinylnaphthalene;

carboxyl group-containing vinyl monomers and metal salts thereof: unsaturated monocarboxylic acids having 3 to 30 carbon atoms, unsaturated dicarboxylic acids, anhydrides thereof and monoalkyl (having 1 to 11 carbon atoms) esters thereof (such as maleic acid, maleic anhydride, maleic acid monoalkyl esters, fumaric acid, fumaric acid monoalkyl esters, crotonic acid, itaconic acid, itaconic acid monoalkyl esters, itaconic acid glycol monoethers, citraconic acid, citraconic acid monoalkyl esters or carboxyl group-containing vinyl-based monomers of cinnamic acid);

vinyl esters (such as vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate or ethyl α-ethoxyacrylate), alkyl acrylates and alkyl methacrylates having an alkyl group (linear or branched) having 1 to 11 carbon atoms (such as methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, dialkyl fumarate (fumaric acid dialkyl ester) (wherein, the two alkyl groups are linear, branched or alicyclic groups having 2 to 8 carbon atoms), or dialkyl maleate (maleic acid dialkyl ester) (wherein, the two alkyl groups are linear, branched or alicyclic groups having 2 to 8 carbon atoms); polyaryloxyalkanes (such as diaryloxyethane, triaryloxyethane, tetraaryloxyethane, tetraaryloxypropane, tetraaryloxybutane or tetra-meta-aryloxyethane); vinyl-based monomers having a polyalkylene glycol chain (such as polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol 10 mole ethylene oxide (ethylene oxide is to be abbreviated as EO) adduct acrylate, methyl alcohol 10 mole ethylene oxide (ethylene oxide is to be abbreviated as EO) adduct methacrylate, lauryl alcohol 30 mole EO adduct acrylate or lauryl alcohol 30 mole EO adduct methacrylate); and polyacrylates and polymethacrylates (such as polyacrylates and polymethacrylates of polyvalent alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate or polyethylene glycol dimethacrylate).

Moreover, in the present invention, the use of a block polymer obtained by chemically linking segments capable of forming a crystalline structure, namely a crystalline resin component, and segments incapable of forming a crystalline structure, namely an amorphous resin component, for the above-mentioned resin (A) is also a preferable embodiment thereof.

The block polymer can be used in the form of an XY-type diblock polymer consisting of a crystalline resin component (X) and an amorphous resin component (Y), an XYX-type triblock polymer, a YXX-type triblock polymer or an XYXY . . . -type multiblock polymer and the like.

In the present invention, methods that can be used to form a block polymer are a method in which the component that forms the crystalline moiety composed of a crystalline resin component and the component that forms an amorphous moiety composed of an amorphous resin component are prepared separately followed by linking both (two-stage method), and a method in which the raw materials of the component that forms the crystalline moiety and the component that forms the amorphous moiety are charged simultaneously and prepared all at once (one-stage method).

The block polymer used in the present invention can be a block polymer obtained by selecting from various methods in consideration of the reactivity of each terminal functional group.

In the case both the crystalline resin component and amorphous resin component are vinyl resins, a block polymer can be prepared by polymerizing one of the components followed by initiating polymerization of the other component from the end of that vinyl polymer.

In the case both the crystalline resin component and amorphous resin component are polyester resins, a block polymer can be prepared by separately preparing each component followed by linking using a linker. The components can be linked without using a linker particularly in the case the acid value of one of the polyesters is high while the hydroxyl value of the other polyester is high. The reaction temperature at this time is preferably in the vicinity of 200° C.

In the case of using a linker, examples of linkers include the following: polyvalent carboxylic acids, polyvalent alcohols, polyvalent isocyanates, polyfunctional epoxies and polyvalent acid anhydrides. The use of these linkers makes it possible to carry out synthesis by a dehydration reaction or addition reaction.

On the other hand, in the case in which the crystalline resin component is a polyester resin and the amorphous resin component is a polyurethane resin, a block polymer can be prepared by separately preparing each component followed by carrying out a urethanation reaction between the alcohol terminal of the polyester resin and the isocyanato terminal of the polyurethane resin. In addition, a block polymer can also be synthesized by mixing a polyester resin having an alcohol terminal with a diol and diisocyanate that compose the polyurethane resin followed by heating. Early in the reaction when the concentrations of the diol and diisocyanate are high, the diol and diisocyanate react selectively resulting in the formation of polyurethane resin, and after molecular weight has increased to a certain degree, a urethanation reaction occurs between the isocyanato terminal of the polyurethane resin and the alcohol terminal of the polyester resin, thereby allowing the obtaining of a block polymer.

The ratio of crystalline resin component (namely, segments capable of forming a crystalline structure) within the above-mentioned block polymer is preferably 30.0 mass % or more, more preferably 50.0 mass % or more, and particularly preferably 70.0 mass % or more.

Other amorphous resins may be mixed into the above-mentioned binder resin in addition to the above-mentioned resin (A). An amorphous resin similar to that which can be contained as a constituent of the previously described resin (A) can be used as amorphous resin. In addition, the content of the resin (A) in the binder resin is preferably 70.0 mass % or more and more preferably 90.0 mass % or more.

The toner particles in the present invention (both untreated and treated) may be toner particles having a core-shell structure composed of two phases, consisting of a core phase and shell phase, as necessary. Although there are no particular limitations on a resin (B) used to form the shell phase, examples thereof include the resins indicated below:

vinyl-based resin, urethane resin, epoxy resin, ester resin, polyamide, polyimide, silicone resin, fluorine resin, phenol resin, melamine resin, benzoguanamine-based resin, urea resin, aniline resin, ionomer resin, polycarbonate, cellulose and mixtures thereof.

In addition, the resin (B) that forms the shell phase may be a resin capable of forming a crystalline structure. In this case, the peak temperature of the maximum endothermic peak of the resin (B) as determined by DSC measurement of the toner particles is preferably higher than the peak temperature of the maximum endothermic peak of the above-mentioned resin (A).

The toner particles used in the toner of the present invention (both untreated and treated) may also contain a wax as necessary. The wax is preferably such that the peak temperature of the maximum endothermic peak as determined by DSC measurement of the toner particles is higher than the peak temperature of the maximum endothermic peak of the above-mentioned resin (A). Examples of wax include, but are not limited to, the waxes indicated below:

aliphatic hydrocarbon waxes in the manner of low molecular weight polyethylene, low molecular weight polypropylene, low molecular weight olefin copolymer, microcrystalline wax, paraffin wax or Fischer-Tropsch wax, oxides of aliphatic hydrocarbon waxes in the manner of oxidized polyethylene wax, wax having, as main component, aliphatic ester in the manner of aliphatic hydrocarbon ester wax, wax obtained by deoxidizing all or a portion of a fatty acid ester in the manner of deoxidized carnauba wax, partial esterification products of fatty acids and polyvalent alcohols in the manner of behenic acid monoglyceride, and methyl ester compounds having a hydroxyl group obtained by hydrogenating a vegetable oil.

Aliphatic hydrocarbon wax and ester wax are used particularly preferably in the present invention in the case of a dissolution suspension method based on the ease of preparing a wax dispersion, ease of incorporating in a prepared toner, exudability from toner during fixation and mold releasability. In the present invention, an ester wax refers to that having at least one ester bond in a molecular thereof, and a natural ester wax or synthetic ester wax may be used.

Examples of synthetic ester waxes include monoester waxes synthesized from long-chain, linear saturated fatty acids and long-chain, linear saturated aliphatic alcohols. Long chain, linear saturated fatty acids are represented by the general formula $C_nH_{2n+1}COOH$ and those in which n=5 to 28 are used preferably. In addition, long chain, linear saturated aliphatic alcohols are represented by the formula $C_nH_{2n+1}OH$ and those in which n=5 to 28 are used preferably. In addition, examples of natural ester waxes include candelilla wax, carnauba wax, rice wax and derivatives thereof.

Among those described above, synthetic ester wax obtained from a long chain, linear saturated fatty acid and long chain, linear saturated aliphatic alcohol, or natural wax having the above-mentioned esters as a main component, is preferable. Moreover, in the present invention, that in which the ester is a monoester in addition to having the above-mentioned linear structure is more preferable. In addition, in the present invention, the use of a hydrocarbon wax is also a preferable embodiment thereof.

In the present invention, the content of wax in the toner is preferably from at least 1.0 mass % to not more than 20.0 mass %, and more preferably from at least 2.0 mass % to not more than 15.0 mass %. Adjusting the wax content to be within the above-mentioned range makes it possible to further improve toner releasability, and increases resistance to the occurrence of coiling of transfer paper even if the fixing body is at a low temperature. Moreover, heat-resistant storability can be further improved since exposure of the wax on the toner surface can be made to be in a suitable state.

In the present invention, the wax preferably has a maximum endothermic peak of from 60° C. to 120° C., and more preferably from 60° C. to 90° C., as determined by DSC measurement. As a result of adjusting the maximum endothermic peak to be within the above-mention range, heat-resistant storability can be further improved since exposure of wax on the toner surface can be made to be in a suitable state. On the other hand, since the wax is suitably easily melted during fixation, low-temperature fixability and offset resistance can be further improved.

In the present invention, the toner particles (untreated and treated) contain a colorant for imparting tinting strength. Examples of preferably used colorants include organic pigments, organic dyes, inorganic pigments, and carbon black as black colorant and magnetic powder, and colorants used in conventional toners can be used.

Examples of yellow colorants include the following: condensed azo compounds, isoindoline compounds, anthraquinone compounds, azo metal complexes, methine compounds and allylamide compounds, and more specifically, pigments such as C.I. Pigment Yellow 12, 13, 14, 15, 17, 62, 74, 83, 93, 94, 95, 109, 110, 111, 128, 129, 147, 155, 168 or 180 are used preferably.

Examples of magenta colorants include the following: condensed azo compounds, diketopyrrolopyrrole compounds, anthraquinones, quinacridone compounds, basic dye lake compounds, naphthol compounds, benzimidazolone compounds, thioindigo compounds and perylene compounds. More specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 or 254 is used preferably.

Examples of cyan colorants include the following: copper phthalocyanine compounds and derivatives thereof, anthraquinone compounds and basic dye lake compounds. More specifically, C.I. Pigment Blue 1, 7, 15, 15:1, 15:2, 15:3, 15:4, 60, 62 or 66 is used preferably.

These colorants can be used or alone or as a mixture, and can also be used in the state of a solid solution. In addition, the colorant used is selected based on hue angle, chroma, lightness, lightfastness, OHP transparency and dispersibility in a toner composition.

The content of colorant is preferably from at least 1.0 mass part to not more than 20.0 mass parts per 100.0 mass parts of the binder resin. In the case of using carbon black as a black colorant as well, the colorant content is similarly from at least 1.0 mass part to not more than 20.0 mass parts per 100.0 mass parts of the binder resin.

In the case of producing untreated toner particles in an aqueous medium, attention is preferably paid to the aqueous phase migration of these colorants, and these colorants are preferably subjected to surface modification in the manner of hydrophobic treatment as necessary. On the other hand, in addition to treatment similar to that described above, carbon black may be subjected to grafting treatment with a substance that reacts with surface functional groups of the carbon black such as polyorganosiloxane. In addition, in the case of using magnetic powder as a black colorant, the added amount thereof is preferably from at least 40.0 mass parts to not more than 150.0 mass parts per 100.0 mass parts of the binder resin.

The magnetic powder has, as a main component, iron oxide in the manner of triiron tetraoxide or γ-iron oxide and is typically hydrophilic. Consequently, in the case of producing toner particles in an aqueous medium, magnetic powder easily becomes unevenly distributed on the surface of the toner particles as a result of interacting with water, and the resulting toner particles tend to have inferior flowability and triboelectric charging uniformity due to magnetic powder exposed on the surface thereof. Thus, the surface of the magnetic powder is preferably uniformly subjected to hydrophobic treatment with a coupling agent. Examples of coupling agents that can be used include silane coupling agents and titanium coupling agents and silane coupling agents are used particularly preferably.

In the present invention, a charge control agent may also be contained in the toner particles as necessary. In addition, the charge control agent may be added externally to the toner particles. The incorporation of a charge control agent makes it possible to stabilize charge characteristics and control triboelectric charge quantity to the optimum level corresponding to the developing system.

A known charge control agent can be used for the charge control agent, and a charge control agent having a rapid charging rate that is also able to stably maintain a constant charge quantity is particularly preferable.

Organic metal compounds and chelate compounds are effective for use as charge control agents that control toner to negative chargeability, and examples thereof include monoazo metal compounds, acetyl acetone metal compounds, aromatic oxycarboxylic acids, aromatic dicarboxylic acids, and oxycarboxylic acid- and dicarboxylic acid-based metal compounds. Examples of charge control agents that control toner to positive chargeability include nigrosine, quaternary ammonium salts, metal salts of higher fatty acids, diorganotin borates, guanidine compounds and imidazole compounds.

The incorporated amount of charge control agent is preferably from at least 0.01 mass parts to not more than 20.0 mass parts, and more preferably from at least 0.5 mass parts to not more than 10.0 mass parts, per 100.0 mass parts of the binder resin.

In the present invention, although there are no particular limitations on the method used to produce toner particles, examples thereof include toner particle production methods such as dissolution suspension, suspension polymerization, emulsion aggregation or pulverization.

Among these methods, dissolution suspension is preferable since it enables toner particles to be produced without imparting thermal hysteresis equal to or higher than the melting point of the crystalline resin. Dissolution suspension refers to a method involving preparing a resin composition obtained by dissolving or dispersing binder resin and other additives in an organic solvent, and dispersing the resulting resin composition in a dispersion medium to form a dispersion of liquid particles of the resin composition, followed by removing the organic solvent. According to this method, toner particles can be produced that demonstrate a low decrease in crystallinity of crystalline resin contained in toner particles.

Although an aqueous medium is typically used for the above-mentioned dispersion medium, in the present invention, a dissolution suspension method that uses highly pressurized carbon dioxide for the dispersion medium is particularly preferable from the viewpoint of being able to maintain crystallinity of the crystalline resin in even higher state.

<Untreated Toner Particle Production Method 1: Dissolution Suspension Method Using Highly Pressurized Carbon Dioxide>

In the dissolution suspension method using highly pressurized carbon dioxide, untreated toner particles are produced by going through:

(i) a step of obtaining a resin composition by dissolving or dispersing a binder resin comprising resin (A) and a colorant in an organic solvent able to dissolve the binder resin;

(ii) a step of obtaining a dispersion by dispersing the resin composition in a dispersion medium comprising carbon dioxide at from at least 1.0 MPa to not more than 20.0 Mpa; and (iii) a step of removing the organic solvent from the dispersion.

In the above-mentioned step (i), binder resin comprising resin (A), colorant and, as necessary, wax and other additives are first added to an organic solvent able to dissolve the binder resin, followed by uniformly dissolving or dispersing with a disperser in the manner of a homogenizer, ball mill, colloid mill or ultrasonic disperser. Examples of the above-mentioned organic solvent include the solvents indicated below:

ketone-based solvents in the manner of acetone, methyl ethyl ketone, methyl isobutyl ketone and di-n-butyl ketone, ester-based solvents in the manner of ethyl acetate, butyl acetate and methoxybutyl acetate, ether-based solvents in the manner of tetrahydrofuran, diethyl ether, dioxane, ethyl cellosolve and butyl cellosolve, amide-based solvents in the manner of dimethylformamide and dimethylacetoamide, and aromatic hydrocarbon-based solvents in the manner of toluene, xylene and ethylbenzene.

In the above-mentioned step (ii), the resulting solution or dispersion (to also be simply referred to as the resin composition) is dispersed in a dispersion medium comprising carbon dioxide at 1.0 MPa to 20.0 MPa to form a dispersion (oil droplets).

The carbon dioxide may be used as a dispersion medium or may be contained by the organic solvent as another component thereof. In this case, the highly pressurized carbon dioxide and organic solvent preferably form a homogeneous phase.

At this time, a dispersant is preferably dispersed in the dispersion medium comprising the highly pressurized carbon dioxide. Examples of dispersants include inorganic fine particle dispersants and organic fine particle dispersants, and two or more types of dispersants may be used as a mixture corresponding to the purpose thereof.

Examples of inorganic fine particle dispersants include inorganic particles such as silica, alumina, zinc oxide, titania or calcium oxide.

Examples of organic fine particle dispersants include fine particles of vinyl resin, urethane resin, epoxy resin, ester resin, polyamide, polyimide, silicone resin, fluorine resin, phenol resin, melamine resin, benzoguanamine resin, urea resin, aniline resin, ionomer resin, polycarbonate and cellulose as well as mixtures thereof.

In the case of using resin fine particles as a dispersant, the use of fine particles of an amorphous resin causes toner particles to aggregate easily since highly pressurized carbon dioxide penetrates into the amorphous resin and causes the amorphous resin to plasticize, thereby lowering the glass transition temperature (Tg) of the amorphous resin. Thus, a crystalline resin is preferably used for the resin fine particles, and in the case of using an amorphous resin, a crosslinked structure is preferably introduced therein. In addition, amorphous resin fine particles may be coated with a crystalline resin. Although the dispersant may be used as is, the surface thereof may be modified by various types of treatment in order to improve adsorbability to the surfaces of the oil droplets during granulation. Specific examples of surface modification include surface treatment with a silane-based, titanate-based or aluminate-based coupling agent, surface treatment using various types of surfactants, and coating treatment consisting of coating with a polymer.

Since dispersant that has adsorbed to the surfaces of the oil droplets remains as is even after the formation of toner particles, in the case of using resin fine particles as a dispersant, the surface of the toner particles can be coated for use as the resin (B) that forms the shell phase.

In the present invention, the particle diameter of resin fine particles containing the above-mentioned resin (B) in terms of the volume-average particle diameter is preferably from at least 30 nm to not more than 300 nm and more preferably from at least 50 nm to not more than 200 nm. In the case the particle diameter of the resin fine particles is excessively small, stability of the oil droplets tends to decease during granulation. In the case it is excessively large, it becomes difficult to control the particle diameter of the oil droplets to a desired size.

In addition, the incorporated amount of fine particles is preferably from at least 3.0 mass parts to not more than 15.0 mass parts per 100 mass parts of the solid fraction contained in the solution of materials that composes the above-mentioned toner particles, and can be suitably adjusted according to stability of the liquid particles and desired particle diameter.

In the present invention, any method may be used to disperse the dispersant in the dispersion medium containing the highly pressurized carbon dioxide. A specific example thereof is a method involving charging the dispersant and dispersion medium containing highly pressurized carbon dioxide into a container followed by dispersing directly by stirring or irradiating with ultrasonic waves. In addition, another example involves introducing a dispersion, obtained by dispersing the dispersant in an organic solvent, into a container charged with the dispersion medium containing the highly pressurized carbon dioxide using a high-pressure pump.

In addition, in the present invention, any method may be used to disperse the resin composition in the dispersion medium containing the highly pressurized carbon dioxide. A specific example thereof is a method involving introducing the resin composition into a container containing the dispersion medium that contains the highly pressurized carbon dioxide having the dispersant dispersed therein using a high-pressure pump. In addition, the dispersion medium containing the highly pressurized carbon dioxide having the dispersant dispersed therein may also be introduced into a container charged with the resin composition.

In the present invention, the dispersion medium containing the highly pressurized carbon dioxide is preferably a homogeneous phase. In the case of carrying out granulation by dispersing the resin composition in highly pressurized carbon dioxide, a portion of the organic solvent in the oil droplets migrates into the dispersion. At this time, in the case a state exists in which the carbon dioxide phase and organic solvent phase have separated, stability of the oil droplets tends to decrease. Thus, the temperature and pressure of the dispersion medium and the amount of resin composition relative to the highly pressurized carbon dioxide are preferably adjusted to be within ranges that enable the carbon dioxide and organic solvent to form a homogeneous phase.

In addition, attention is also paid to the granulating properties (ease of forming oil droplets) and solubility of constituents in the resin composition in the dispersion medium with respect to the temperature and pressure of the dispersion medium. For example, binder resin and wax in the resin composition may dissolve in the dispersion medium depending on temperature conditions and pressure conditions. Although solubility of the above-mentioned components in the dispersion medium is normally suppressed the lower the temperature and the lower the pressure, the formed oil droplets become susceptible to the occurrence of aggregation and unification, resulting in a decrease in granulating properties. On the other hand, although granulating properties improve the higher the temperature and pressure, the above-mentioned components tend to easily dissolve in the dispersion medium. Thus, in the production of toner particles, the temperature of the dispersion medium is preferably within a range of 10° C. to 40° C.

In addition, the pressure within the container used to form the dispersion medium is preferably from 1.0 MPa to 20.0 MPa and more preferably from 2.0 MPa to 15.0 MPa. Furthermore, in the case of components other than carbon dioxide being contained in the dispersion medium, pressure in the present invention refers to the total pressure thereof.

In the above-mentioned step (iii), following completion of granulation, organic solvent remaining in the oil droplets is removed through the dispersion medium comprising the highly pressurized carbon dioxide. More specifically, this is carried out by further mixing the highly pressurized carbon dioxide into a dispersion medium in which oil droplets have been dispersed, extracting residual organic solvent into the carbon dioxide phase, and further replacing the carbon dioxide containing the organic solvent with highly pressurized carbon dioxide.

When mixing a dispersion medium with highly pressurized carbon dioxide, carbon dioxide at a higher pressure may be added to the dispersion medium, or carbon dioxide at a lower pressure may be added to the dispersion medium.

An example of a method used to further replace the carbon dioxide containing organic solvent with highly pressurized carbon dioxide involves allowing highly pressurized carbon dioxide to circulate through the container while maintaining the pressure in the container at a constant pressure. At this time, the toner particles formed may be captured with a filter.

If replacement using highly pressurized carbon dioxide is inadequate and organic solvent remains in the dispersion medium, organic solvent that has dissolved in the dispersion medium condenses when the pressure inside the container is reduced to recover the resulting toner particles, which may cause the toner particles to re-dissolve or cause toner particles to join together. Thus, replacement using highly pressurized carbon dioxide is preferably carried out until the organic solvent has been completely removed. The circulated amount of highly pressurized carbon dioxide is preferably from 1 to 100 times, preferably from 1 to 50 times, and even more preferably from 1 to 30 times, the volume of the dispersion medium.

In this manner, in the case of producing toner particles according to the dissolution suspension method using carbon dioxide for the dispersion medium, a portion of the toner production device can be used as a pressure holding device used in the production method of the present invention.

In this case, production can proceed to pressurized annealing treatment after the above-mentioned step (iii) without having to go through a step of removing toner particles from a container by adjusting the temperature and pressure. Consequently, pressurized annealing treatment can be carried out more efficiently in comparison with other production methods.

When reducing pressure inside the container and removing toner particles from the dispersion containing highly pressurized carbon dioxide in which toner particles are dispersed, although pressure may be reduced at all once to normal temperature and normal pressure, pressure may also be reduced in a stepwise manner by providing multiple stages of containers for which pressure is independently controlled. The depressurization rate is preferably set to a range at which the toner particles do not foam. Furthermore, the organic solvent and carbon dioxide used in the present invention can be recycled.

<Untreated Toner Particle Production Method 2: Dissolution Suspension Method Using Aqueous Medium>

In a dissolution suspension method using an aqueous medium, untreated toner particles are produced by going through:

(i) a step of obtaining a resin composition by dissolving or dispersing a binder resin comprising a resin (A) and a colorant in an organic solvent able to dissolve the binder resin;

(ii) a step of obtaining a dispersion by dispersing the resin composition in an aqueous medium; and (iii) a step of removing the organic solvent from the dispersion.

The above-mentioned step (i) is carried out in the same manner as step (i) in the previously described Toner Particle Production Method 1.

In the above-mentioned step (ii), a dispersion is obtained in which oil droplets of the resin composition are dispersed by dispersing the resin composition obtained in the above-mentioned step (i) in an aqueous medium to which has been added a dispersant in the manner of a surfactant or water-soluble polymer.

Examples of surfactants include anionic surfactants, cationic surfactants, amphoteric surfactants and nonionic surfactants, and can be arbitrarily selected in a form that is compatible with the polarity during formation of toner particles.

Specific examples of surfactants include anionic surfactants in the manner of alkylbenzene sulfonates, α-olefin sulfonates and phosphoric acid esters, amine salt-type cationic surfactants in the manner of alkyl amine salts, aminoalcohol fatty acid derivatives, polyamine fatty acid derivatives and imidazoline, and quaternary ammonium salt-type cationic surfactants in the manner of alkyltrimethyl ammonium salts, dialkyldimethyl ammonium salts, alkyldimethylbenzyl ammonium salts, pyridinium salts, alkylisoquinolinium salts and benzetonium chloride, nonionic surfactants in the manner of fatty acid amide derivatives and polyvalent alcohol derivatives, and amphoteric surfactants in the manner of alanine, dodecyldi(aminoethyl)glycine, di(octylaminoethyl) glycine and N-alkyl-N,N-dimethylammonium betaine.

Examples of substances that can be used as water-soluble polymers include acids such as acrylic acid, methacrylic acid, α-cyanoacrylic acid, α-cyanomethacrylic acid, itaconic acid, crotonic acid, fumaric acid, maleic acid or maleic anhydride, (meth)acrylic monomers containing an hydroxyl group (such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxpropyl methacrylate, diethylene glycol monoacrylate, diethylene glycol monomethacrylate, glycerin monoacrylate, glycerin monomethacrylate, N-methylol acrylamide or N-methylol methacrylamide), vinyl alcohol or ethers of vinyl alcohol (such as vinyl methyl ether, vinyl ethyl ether or vinyl propyl ether), esters of vinyl alcohol and compounds containing a carboxyl group (such as vinyl acetate, vinyl propionate or vinyl butyrate), acrylamide, methacrylamide, diacetone acrylamide or methylol compounds thereof, acid chlorides such as acrylic acid chlorides and methacrylic acid chlorides, homopolymers or copolymers having a nitrogen atom or heterocyclic ring thereof such as vinyl pyridine, vinyl pyrrolidone, vinyl imidazole or ethyleneimine, polyoxyethylene-based polymers such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester or polyoxyethylene nonyl phenyl ester, and celluloses such as methyl cellulose, hydroxyethyl cellulose or hydroxypropyl cellulose.

In the case of using a dispersant, although the dispersant can be allowed to remain on the surface of the toner particles, it is preferably removed by dissolving and washing from the viewpoint of toner charge.

In addition, a solid dispersion stabilizer may also be used to maintain a more preferable dispersed state. In the present invention, a dispersion stabilizer is used for the reason indicated below. Namely, since the organic medium in which the main component of toner particles in the form of binder resin is dissolved is highly viscous, the dispersion stabilizer surrounds the periphery of the formed oil droplets by finely dispersing the organic medium at high shear force, thereby stabilizing the dispersion by preventing oil droplets from re-aggregating.

An inorganic dispersion stabilizer or organic dispersion stabilizer can be used for the dispersion stabilizer. In the case of an inorganic dispersion stabilizer, since toner particles are granulated while the inorganic stabilizer is adhered to the particle surfaces following dispersion, the inorganic dispersion stabilizer does not demonstrate affinity with organic media and can be removed by an acid such as hydrochloric acid, thereby making this preferable. Examples of inorganic dispersion stabilizers that can be used include calcium carbonate, calcium chloride, sodium bicarbonate, potassium bicarbonate, sodium hydroxide, potassium hydroxide, hydroxyapatite, calcium triphosphate, silica, alumina, zinc oxide and titania. In the case of using resin fine particles as an organic dispersion stabilizer, they can be used to coat the surface of the toner particles as the resin (B) that forms the shell phase.

There are no particular restrictions on the method used to disperse the resin composition, and although the resin composition can be dispersed by using a general-purpose dispersion device such as a low-speed shearing type, high-speed shearing type, friction type, high-pressure jet type or ultrasonic type, a high-speed shearing type is preferable since the dispersed particle diameter can be made to be roughly 2 μm to 20 μm.

There are no particular restrictions on stirring devices having a rotor, and those commonly used as an emulsifier or disperser can be used.

Examples thereof include continuous emulsifiers such as the Ultra-Turrax (IKA Japan K.K.), Polytron (Kinematica GmbH), TK Auto Homomixer (Tokushu Kika Kogyo Co., Ltd.), Ebara Milder (Ebara Corp.), TK Homomic Line Flow (Tokushu Kika Kogyo Co., Ltd.), Colloid Mill (Shinko Pantech K.K.), Slasher, Trigonal Wet Pulverizer (Mitsui Miike Machinery Co., Ltd.), Cavitron (Eurotec Ltd.) or Fine Flow Mill (Pacific Ocean Machinery & Engineering Co., Ltd.), batch-type emulsifiers such as the Clear Mix (M Technique Co., Ltd.) or Filmics (Tokushu Kika Kogyo Co., Ltd.), and combination continuous/batch-type emulsifiers.

In the above-mentioned step (iii), a toner particle dispersion is obtained by removing organic solvent from the oil droplets of the resin composition dispersion and solidifying the resin component. A method that removes organic solvent via an aqueous medium can be used to remove organic solvent from the oil droplets. Untreated toner particles are obtained by subsequently going through filtration, washing and drying steps.

<Untreated Toner Particle Production Method 3: Suspension Polymerization Method>

In the suspension polymerization method, untreated toner particles are produced by going through:

(i) a step of obtaining a polymerizable monomer composition by mixing a polymerizable monomer, resin (A) and a colorant;

(ii) a step of forming liquid droplets of the polymerizable monomer composition by dispersing the polymerizable monomer composition in an aqueous medium comprising a dispersion stabilizer; and (iii) a step of polymerizing the polymerizable monomer comprised in liquid droplets of the polymerizable monomer composition.

In the above-mentioned step (i), a polymerizable monomer composition is prepared that comprises a polymerizable monomer, resin (A), colorant and, as necessary, wax and other additives. The colorant may be preliminarily dispersed in the polymerizable monomer and then mixed with other components, or may be dispersed after having mixed all components.

A vinyl-based polymerizable monomer capable of undergoing radical polymerization is used for the polymerizable monomer. More specifically, a polymerizable monomer able to be used in the production of the previously described amorphous vinyl resin can be used alone or two or more types can be used in combination for the vinyl-based polymerizable monomer. In addition, a polymerizable monomer that is a precursor of resin (A) can be used instead of resin (A). More specifically, one or two or more types of a polymerizable monomer able to be used in the production of the previously described crystalline vinyl resin, or polymerizable monomers able to be used in the production of the above-mentioned amorphous vinyl resin, can be used in combination.

In addition, wax can also be added and used as necessary. Moreover, a chain transfer agent, a polymerization inhibitor or a polyfunctional polymerizable monomer having two or more vinyl groups can be further added and used in order to control the degree of polymerization and degree of crosslinking of the resulting polymer.

In the above-mentioned step (ii), the polymerizable monomer composition is added to and dispersed in an aqueous medium comprising a dispersion stabilizer or surfactant and then granulated, and a dispersion of the polymerizable monomer composition is obtained by forming granules of the polymerizable monomer composition in the aqueous medium. The same dispersion stabilizers and surfactants as those used in step (ii) of the previously described Toner Particle Production Method 2 can be used. The granulating step can be carried out in a vertical polymerization vessel installed with, for example, a stirrer having high shear force. A polymerization initiator may be added to the polymerizable monomer composition or may be added after preparing the dispersion of the polymerizable monomer composition. In addition, a water-soluble polymerization initiator may be used in combination as a polymerization assistant.

In the above-mentioned step (iii), a polymer particle dispersion is obtained by polymerizing the polymerizable monomer in the dispersion of the polymerization monomer composition obtained in step (ii). An ordinary polymerization vessel having stirring means and enabling temperature control can be used in the polymerization step in the present invention.

Polymerization is carried out at a temperature of 40° C. or higher and typically carried out at a temperature of from 50° C. to 90° C. Although the polymerization temperature may be constant throughout the reaction, the polymerization temperature may be raised during the latter half of the polymerization step of the purpose of obtaining a desired molecular weight distribution. Any stirring means may be used for the stirring means used in the polymerization vessel provided it is able to suspend the dispersed polymerizable monomer composition without stagnating and maintain a constant internal temperature.

Next, the dispersion of polymer particles may be treated with acid or base for the purpose of removing dispersion stabilizer adhered to the polymer particle surfaces. Subsequently, although the polymer particles are separated from the liquid phase by an ordinary solid-liquid separation method, water is again added and the polymer particles are washed therewith in order to completely remove acid or base as well as dispersion stabilizer components dissolved therein. After adequately washing the polymer particles by repeating this washing step several times, solid-liquid separation is carried out again followed by drying to obtain untreated toner particles.

<Untreated Toner Particle Production Method 4: Emulsion Aggregation Method>

In the emulsion aggregation method, toner particles are produced by going through:

(i) a step of obtaining a binder resin fine particle dispersion by dispersing a binder resin comprising resin (A) in an aqueous medium or an organic solvent that does not dissolve the above-mentioned binder resin;

(ii) a step of obtaining a colorant fine particle dispersion by dispersing the above-mentioned colorant in water or an organic solvent that does not dissolve the above-mentioned binder resin; (iii) a step of forming aggregated particles by mixing the binder resin fine particle dispersion and the colorant fine particle dispersion; and (iv) a step of heating the aggregated particles at a temperature equal to or higher than a melting point or a glass transition temperature of the binder resin to fuse the aggregated particles.

In the above-mentioned step (i), a binder resin is dissolved in an organic solvent and placed in an aqueous medium to which a surfactant has been added (or an organic solvent that does not dissolve the binder resin). A binder resin fine particle dispersion is obtained by removing the organic solvent while dispersing using a disperser.

The colorant is placed in an ordinary wet pulverizer together with a surfactant and an aqueous medium (or an organic solvent that does not dissolve the binder resin) to obtain a colorant fine particle dispersion by dispersing therein.

In the above-mentioned step (ii), the binder resin fine particle dispersion and the colorant fine particle dispersion are mixed and dispersed with a disperser to obtain a toner composition dispersion in which each of the dispersed fine particles is dispersed. A wax fine particle dispersion may also be added to the toner composition dispersion as necessary. The wax fine particle dispersion used is obtained by placing wax in an ordinary wet pulverizer together with a surfactant and an aqueous medium and dispersing. Moreover, an aggregated particle dispersion in which each of the dispersed fine particles have aggregated is obtained by adding an aggregating agent and stirring for a certain amount of time. A polyvalent ionic material having a valence of 2 or more can be used for the aggregating agent. Specific examples thereof include metal salts such as calcium chloride, calcium nitrate, barium chloride, magnesium chloride, zinc chloride, aluminum chloride or aluminum sulfate, and inorganic metal salt polymers such as polyaluminum chloride, polyaluminum hydroxide or calcium polysulfide. Among these, aluminum salts and polymers thereof are particularly preferable. In general, in order to obtain a sharper particle size distribution, the valence of the inorganic metal salt is more preferably 2 than 1 and more preferably 3 or more than 2, and in the case of having the same valence, a polymer type of inorganic metal salt polymer is more suitable. These aggregating agents are added to the toner composition dispersion in the form of an aqueous solution.

In the above-mentioned step (iii), the aggregated particle dispersion is heated to a temperature equal to or higher than the glass transition temperature or melting point of the binder resin while stirring continuously to fuse the aggregated particles and obtain a toner particle dispersion. Subsequently, the toner particle dispersion is cooled, filtered, washed and dried to obtain untreated toner particles.

<Untreated Toner Particle Production Method 5: Pulverization Method>

In the pulverization method, untreated toner particles are produced by going through:

(i) a step of obtaining a kneaded product by melting and kneading the binder resin comprising the resin (A) and the colorant; and (ii) a step of pulverizing the kneaded product.

In the above-mentioned step (i), prescribed amounts of a binder resin comprising resin (A), a colorant, and as necessary, other components such as a wax or charge control agent are weighed out and blended followed by mixing. Examples of mixing devices include a double cone mixer, V-shaped mixer, drum-type mixer, super mixer, Henschel mixer, Nauta mixer and mechanohybrid mixer.

Next, the mixed materials are melted and kneaded, and the colorant and other components are dispersed in the binder resin. A batch-type kneading machine in the manner of a pressurized kneader or Banbury mixer, or a continuous-type kneading machine, can be used for mixing and kneading. A single-screw or twin-screw extruder is preferable based on its superiority in enabling continuous production, and examples thereof include the Model KTK Twin-Screw Extruder (Kobe Steel, Ltd.), Model TEM Twin-Screw Extruder (Toshiba Machine Co., Ltd.), PCM Kneader (Ikegai Co., Ltd.), Twin-Screw Extruder (KCK Engineering Ltd.), Co-Kneader (Buss Corp.) and Kneadex (Nippon Coke & Engineering Co., Ltd.).

Moreover, the resin composition obtained by melting and kneading is rolled out with a two-roll mill and cooled.

In the above-mentioned step (ii), the resulting kneaded product is cooled and pulverized to a desired particle diameter. An example of a pulverizing method involves coarsely pulverizing with a crushing machine in the manner of a crusher, hammer mill or feather mill, followed by pulverizing with the Kryptron System (Kawasaki Heavy Industries, Ltd.), Super Rotor (Nisshin Engineering Inc.), Turbo Mill (Freund-Turbo Corp.) or air jet pulverizer.

Subsequently, the pulverized particles are sized using a classifier or sieve size analyzer in the manner of an internal classification system type of Elbow Jet Classifier (Nittetsu Mining Co., Ltd.) or centrifugal classification system type of Turboplex Classifier (Hosokawa Micron Ltd.), TSP Separator (Hosokawa Micron Ltd.) or Faculty System (Hosokawa Micron Ltd.) as necessary to obtain toner particles.

In the toner of the present invention, an inorganic fine powder can also be added externally to the above-mentioned toner particles. The inorganic fine powder has functions that improve flowability of the toner and equalize the toner charge.

Examples of the above-mentioned inorganic fine powder include fine powders in the manner of silica fine powder, titanium oxide fine powder, alumina fine powder and compound oxide fine powders thereof. Among these inorganic fine powders, silica fine powder and titanium oxide fine powder are preferable.

Examples of silica fine powder include dry silica or fumed silica formed by vapor phase oxidation of a silicon halide, and wet silica produced from water glass. Dry silica having a small number of silanol groups on the surface and inside the silica fine powder and having a low content of $Na_2O$ and $SO_3^{2-}$ is preferable. In addition, the dry silica may be a compound fine powder of silica and another metal oxide produced by using a metal halide such as aluminum chloride or titanium chloride with the silicon halide in the production process.

In addition, since the inorganic fine powder per se is able to achieve adjustment of the amount of the toner charge, improvement of environmental stability and improvement of properties in a high-temperature environment as a result of being subjected to hydrophobic treatment, an inorganic fine powder that has undergone hydrophobic treatment is more preferable for use as inorganic fine powder. If the inorganic fine powder added externally to the toner absorbs moisture, the amount of charge as toner decreases resulting in increased susceptibility to the occurrence of decreases in developability and transferability.

Examples of treatment agents used during hydrophobic treatment of inorganic fine powder include unmodified silicone varnish, various types of modified silicone varnish, unmodified silicone oil, various types of modified silicone oil, silane compounds, silane coupling agents, and other organic silicon compounds and organic titanium compounds. These treatment agents may be used alone or in combination.

Among these, inorganic fine powder treated with silicone oil is preferable. Hydrophobically treated inorganic fine powder treated with silicone oil either simultaneous to or following hydrophobic treatment of inorganic fine powder with a coupling agent is more preferable in terms of maintaining the amount of toner charge at a high level and reducing selective development.

The amount of the above-mentioned inorganic fine powder added is preferably from at least 0.1 mass parts to not more than 4.0 mass parts, and more preferably from at least 0.2 mass parts to not more than 3.5 mass parts, per 100 mass parts of the toner particles.

The weight-average particle diameter (D4) of the toner of the present invention is preferably from 3.0 μm to 8.0 μm and more preferably from 5.0 μm to 7.0 μm. The use of toner having such a weight-average particle diameter (D4) is preferable in terms of ensuring favorable toner handling ease and adequately satisfying dot reproducibility. The ratio (D4/D1) of the weight-average particle diameter (D4) to the number-average particle diameter (D1) of the resulting toner is preferably 1.25 or less and more preferably 1.20 or less.

The following provides a description of methods used to measure the values of various physical properties defined in the present invention.

<Measurement of Toner Weight-Average Particle Diameter (D4) and Number-Average Particle Diameter (D1)>

In the present invention, toner weight-average particle diameter (D4) and number-average particle diameter (D1) are calculated in the manner described below.

A precision particle size distribution measurement device (Coulter Counter Multisizer 3®, Beckman Coulter Inc.) using the pore electrical resistance method and equipped with a 100 μm aperture tube was used for the measuring instrument. Setting of measurement conditions and analysis of measurement data were carried out using the dedicated software provided (Beckman Coulter Multisizer 3 Version 3.51, Beckman Coulter Inc.). Furthermore, measurements were carried out using 25,000 effective measurement channels.

The electrolyte solution used for measurement is obtained by dissolving special grade sodium chloride in ion exchange water to a concentration of about 1% by mass, and Isoton II (Beckman Coulter Inc.), for example, can be used for the electrolyte solution.

Furthermore, the above-mentioned dedicated software is set in the manner indicated below prior to carrying out analysis and measurement.

The total number of counts of the control mode is set to 50,000 particles on the "Change Standard Operating Method (SOM)" screen of the above-mentioned dedicated software, the number of measurements is set to 1, and Kd value is set using "Standard particle: 10.0 μm" (Beckman Coulter Inc.). The threshold value and noise level are set automatically by pressing the "Threshold/noise level measurement button". In addition, the current is set to 1600 μA, the gain to 2, and the electrolyte solution to ISOTON II, and a check is placed in the box indicating "Flush aperture tube after measurement".

Bin interval is set to logarithmic particle diameter, particle diameter bin is set to a 256 particle diameter bin, and particle diameter range is set from 2 μm to 60 μm on the "Pulse to Particle Diameter Conversion Settings" screen of the above-mentioned dedicated software. The following provides a detailed description of the measurement method.

(1) Approximately 200 mL of the above-mentioned electrolyte solution are placed in a 250 mL glass round bottom beaker exclusively for use with the Multisizer 3, and the beaker is placed on a sample stand and stirred with a stirrer rod in the counter-clockwise direction at 24 revolutions/second. Contaminants and air bubbles are then removed from inside the aperture tube with the "aperture flush" function of the dedicated software.

(2) Approximately 30 mL of the above-mentioned electrolyte solution are placed in a 100 mL glass flat bottom beaker. Approximately 0.3 mL of a dispersant in the form of "Contaminon N" (10% by mass aqueous solution of pH 7 neutral detergent for cleaning precision measuring instruments composed of nonionic surfactant, anionic surfactant and organic builder, Wako Pure Chemical Industries, Ltd.) are added thereto after diluting roughly 3-fold by mass with ion exchange water.

(3) An ultrasonic disperser provided with two internal oscillators, having an oscillation frequency of 50 kHz and offset in phase by 180 degrees, and having an electrical output of 120 W (Tetoral 150 Ultrasonic Dispersion System, Nikkaki Bios Co., Ltd.) is prepared. Approximately 3.3 L of ion exchange water are placed in the water tank of the ultrasonic disperser followed by adding about 2 mL of Contaminon N to this water tank.

(4) The beaker described in (2) above is placed in a beaker mounting port of the above-mentioned ultrasonic disperser followed by operating the ultrasonic disperser. The height position of the beaker is adjusted so that the liquid surface of the electrolyte solution in the beaker exhibits maximum oscillation.

(5) Approximately 10 mg aliquots of toner are added a little at a time to the above-mentioned electrolyte solution in the beaker described in (4) above while irradiating the electrolyte solution with ultrasonic waves to disperse the toner therein. Ultrasonic dispersion treatment is continued for an additional 60 seconds. Furthermore, during the course of ultrasonic dispersion, the water temperature in the water tank is suitably adjusted to 10° C. to 40° C.

(6) Using a pipette, the electrolyte solution described in (5) above having toner dispersed therein is dropped into the round bottom beaker described in (1) above placed on the sample stand, and the measurement concentration is adjusted to about 5%. Measurement is carried out until the number of measured particles reaches 50,000 particles.

(7) Measurement data is analyzed with the above-mentioned dedicated software provided with the device followed by calculation of the weight-average particle diameter (D4) and the number-average particle diameter (D1). Furthermore, the "average diameter" displayed on the "Analysis/Volume Statistical Values (Arithmetic Average)" screen when set to graph/volume % with the above-mentioned dedicated software is the weight-average particle diameter (D4), while the "average diameter" displayed on the "Analysis/Number Statistical Values (Arithmetic Average)" screen when set to graph/number % with the above-mentioned dedicated software is the number-average particle diameter (D1).

<Measurement of Peak Temperature Tp1 and Onset Temperature Tp2 of Maximum Endothermic Peak Derived from Resin (A) in Toner Particles>

Peak temperature Tp1 and onset temperature Tp2 of the maximum endothermic peak derived from resin (A) in untreated toner particles are measured under the following conditions using the DSC Q2000 differential scanning calorimetric measurement system (TA Instruments, Inc.).

Ramp rate: 10° C./min

Measurement starting temperature: 20° C.

Measurement ending temperature: 180° C.

Temperature calibration of the system detection unit is carried out using the melting points of indium and zinc, while calorific values are calibrated using the heat of fusion of indium.

More specifically, approximately 5 mg of sample are weighed out and placed in a silver pan followed by carrying out measurement once. The empty silver pan is used as a reference.

The measurement data obtained in the above-mentioned measurement is analyzed using the "TA Instruments Universal Analysis 2000" dedicated software provided with the device followed by calculation of the peak temperature Tp1 and onset temperature Tp2 of the maximum endothermic peak derived from resin (A) capable of forming a crystalline structure. In the case multiple endothermic peaks are present, the above-mentioned maximum endothermic peak refers to the peak having the maximum amount of endothermic energy on a DSC chart. Although wax is also a material present in the toner particles used in the production method of the present invention that demonstrates an endothermic peak in addition to resin (A), based on the contents thereof in the toner particles, the maximum endothermic peak can be specified to be that derived from resin (A).

Furthermore, the peak temperature Tp1 is the temperature at which the above-mentioned maximum endothermic peak reaches a peak. In addition, as shown in FIG. 1, the above-mentioned onset temperature Tp2 is the temperature that indicates the intersection of a straight line obtained by extending the baseline on the low temperature side of the peak in the DSC chart towards the high temperature side, and a straight line drawn along the curve indicating the start of heat absorption during heating at the above-mentioned maximum endothermic peak at the point of the maximum slope thereof.

<Measurement of Glass Transition Temperature (Tg)>

The glass transition temperature of amorphous resin is determined by drawing lines tangent to a curved line indicating maximum heat absorption and the baseline extending to the front and back thereof based on a reversing heat flow curve during heating obtained from the above-mentioned DSC measurement, determining the midpoint of a straight line connecting the intersection of each tangential line, and taking the temperature at that point to be the glass transition temperature.

<Measurement of Number-Average Molecular Weight (Mn) and Weight-Average Molecular Weight (Mw)>

In the present invention, the number-average molecular weight (Mn) and weight-average molecular weight (Mw) of the tetrahydrofuran (THF)-soluble portion of a resin are measured in the manner described below by gel permeation chromatography (GPC).

(1) Preparation of Measurement Sample

Resin (sample) and THF were mixed at a concentration of about 0.5 mg/mL to 5.0 mg/mL (for example, about 5 mg/mL) and allowed to stand for several hours (for example, 5 to 6 hours) at room temperature, followed by shaking well to thoroughly mix the THF and sample until there are no aggregates of the sample present. Moreover, the mixture was allowed to stand undisturbed for 12 hours or more (for example, 24 hours) at room temperature. At this time, the amount of time from the start of mixing of the sample and THF until completion of standing undisturbed was made to be 24 hours or more.

Subsequently, the mixture was passed through a sample treatment filter (pore size: 0.45 μm to 0.50 μm, My Process Disk H-25-2 (Tosoh Corp.) or Ekicrodisk 25CR (Gelman Sciences Japan K.K.) can be used preferably) and used as GPC sample.

(2) Sample Measurement

After stabilizing the column in a heat chamber at 40° C., solvent in the form of THF was allowed to flow through the column at this temperature at a flow rate of 1 mL/min, followed by adding 50 μL to 200 μL of a THF sample solution of resin adjusted to a sample concentration of 0.5 mg/mL to 5.0 mg/mL and measuring.

In measuring sample molecular weight, molecular weight distribution of the sample was calculated from the relationship between the logarithmic value of a calibration curve, prepared with several types of monodispersed polystyrene standard samples, and the number of counts.

Standard polystyrene samples available from Pressure Chemical Co. or Toyo Soda Manufacturing Co., Ltd. having molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$ and $4.48\times10^6$ were used for the standard polystyrene samples for preparing the calibration curve. In addition, an RI (refractive index) detector was used for the detector.

Furthermore, a plurality of commercially available polystyrene gel columns were used in combination in the manner indicated below for the column in order to accurately measure over a molecular weight range of $1\times10^3$ to $2\times10^6$. The GPC measurement conditions used in the present invention are as indicated below.

[GPC Measurement Conditions]

Apparatus: LC-GPC 150C (Waters Corp.)

Columns: Series of 7 columns consisting of the Shodex KF 801, 802, 803, 804, 805, 806 and 807 (Showa Denko K.K.)

Column temperature: 40° C.

Mobile phase: THF (tetrahydrofuran)

<Calculation of Ratio (mass %) of Segments Capable of Adopting Crystalline Structure>

The ratio (mass %) of segments capable of forming a crystalline structure in the binder resin is measured by $^1$H-NMR under the conditions indicated below.

Measuring instrument: JNM-EX400 FT NMR System (JEOL Ltd.)

Measuring frequency: 400 MHz

Pulse duration: 5.0 μs

Frequency range: 10500 Hz

No. of integrations: 64

Measuring temperature: 30° C.

Sample: 50 mg of resin are placed in a sample tube having an inner diameter of 5 mm followed by the addition of solvent in the form of deuterochloroform ($CDCl_3$) and dissolving in a constant temperature bath a 40° C. to prepare the sample.

Peaks assigned to constituents of segments capable of forming a crystalline structure are selected that are independent of peaks assigned to other constituents in a H-NMR chart measured according to the measurement conditions described above, followed by calculating the integrated value $S_1$ of those peaks. Similarly, peaks assigned to constituents of amorphous segments are selected that are independent of peaks assigned to other constituents, followed by calculating the integrated value $S_2$ of those peaks. The ratio of segments capable of forming a crystalline structure is determined in the manner indicated below using the above-mentioned integrated value $S_1$ and integrated value $S_2$. Furthermore, $n_1$ and $n_2$ represent the number of hydrogens in those constituents to which peaks of interest have been assigned.

Ratio of segments capable of forming crystalline structure $$(\text{mol }\%)=\{(S_1/n_1)/((S_1/n_1)+(S_2/n_2))\}\times100$$

The ratio (mol %) of segments capable of forming a crystalline structure obtained in this manner is converted to percent by mass (mass %) using the molecular weight of each component.

<Measurement of Particle Diameter of Binder Resin Fine Particles, Resin Fine Particles, Wax Fine Particles and Colorant Fine Particles>

In the present invention, the particle diameter of each fine particle is measured as the volume-average particle diameter (μm or nm) by measuring over a set range of 0.001 μm to 10 μm using a Microtrac particle size distribution analyzer HRA (X-100, JGC Corp.). Furthermore, water is selected for use as the diluent solvent.

Although the following provides a more detailed explanation of the present invention through examples thereof, the present invention is not limited thereto. Furthermore, parts and percent in the examples and comparative examples are all based on mass unless specifically indicated otherwise.

<Synthesis of Crystalline Polyester 1>

The following raw materials were charged into a heat-dried two-mouth flask while introducing nitrogen.

| | |
|---|---|
| Sebacic acid | 123.7 mass parts |
| 1,6-hexanediol | 76.3 mass parts |
| Dibutyltin oxide | 0.1 mass parts |

After replacing the atmosphere inside the reaction system with nitrogen by reducing pressure, the reaction mixture was stirred for 6 hours at 180° C. Subsequently, the temperature was gradually raised to 230° C. under reduced pressure while continuing to stir followed by holding at that temperature for 2 hours. Crystalline Polyester 1 was then synthesized by allowing the mixture to air-cool and stopping the reaction when it had reached a viscous state. The physical properties of the Crystalline Polyester 1 are shown in Table 1.

TABLE 1

| | Dicarboxylic acid | | Diol | | Polyester Physical Properties | | |
|---|---|---|---|---|---|---|---|
| | Type | Added amount (mass parts) | Type | Added amount (mass parts) | Mn | Mw | Melting point (° C.) |
| Crystalline Polyester 1 | Sebacic acid | 123.7 | 1,6-hexanediol | 76.3 | 5,500 | 12,300 | 68 |
| Crystalline Polyester 2 | 1,10-decanedicarboxylic acid | 112.0 | 1,12-dodecanediol | 88.0 | 10,500 | 36,200 | 97 |
| Crystalline Polyester 3 | Sebacic acid | 104.0 | 1,10-decanediol | 96.0 | 5,400 | 10,800 | 86 |
| Crystalline Polyester 4 | Sebacic acid | 136.0 | 1,4-butanediol | 64.0 | 4,900 | 11,000 | 63 |

<Synthesis of Crystalline Polyesters 2 to 4>

Crystalline Polyesters 2 to 4 were all synthesized in the same manner as the synthesis of Crystalline Polyester 1 with the exception of changing the charging of raw materials as shown in Table 1. The physical properties of Crystalline Polyesters 2 to 4 are shown in Table 1.

<Synthesis of Block Polymer 1>

The following raw materials were charged into a heat-dried two-mouth flask while introducing nitrogen.

| | |
|---|---|
| Xylylene diisocyanate (XDI) | 35.7 mass parts |
| Cyclohexane dimethanol (CHDM) | 25.1 mass parts |
| Tetrahydrofuran (THF) | 80.0 mass parts |

The reaction mixture was heated to 50° C. and a urethanation reaction was carried out over the course of 10 hours. Subsequently, a solution obtained by dissolving 200.0 mass parts of Crystalline Polyester 1 in 220.0 mass parts of THF was gradually added thereto followed by stirring for 5 hours at 50° C. Subsequently, the mixture was allowed to cool to room temperature followed by distilling off the solvent in the form of THF to synthesize Block Polymer 1. The physical properties of Block Polymer 1 are shown in Table 2.

TABLE 2

| | Crystalline resin component | | Amorphous resin component | | | | Block polymer physical properties | | | |
|---|---|---|---|---|---|---|---|---|---|---|
| | Type | Added amount (mass parts) | Type | Added amount (mass parts) | Type | Added amount (mass parts) | Mn | Mw | Ratio of crystalline polyester (mass %) | Melting point (° C.) |
| Block Polymer 1 | Crystalline Polyester 1 | 200.0 | XDI | 29.8 | CHDM | 20.2 | 15,300 | 35,500 | 80 | 60 |
| Block Polymer 2 | Crystalline Polyester 2 | 200.0 | XDI | 29.1 | CHDM | 20.9 | 23,700 | 54,800 | 80 | 89 |
| Block Polymer 3 | Crystalline Polyester 3 | 200.0 | XDI | 29.8 | CHDM | 20.2 | 11,900 | 27,700 | 80 | 78 |
| Block Polymer 4 | Crystalline Polyester 4 | 200.0 | XDI | 30.0 | CHDM | 20.0 | 10,600 | 29,100 | 80 | 55 |
| Block Polymer 5 | Crystalline Polyester 1 | 75.0 | XDI | 99.7 | CHDM | 75.3 | 39,400 | 72,100 | 30 | 59 |
| Block Polymer 6 | Crystalline Polyester 1 | 50.0 | XDI | 113.6 | CHDM | 86.4 | 51,800 | 98,300 | 20 | 59 |

<Synthesis of Block Polymers 2 to 6>

Block Polymers 2 to 6 were synthesized in the same manner as the synthesis of Block Polymer 1 with the exception of changing the charging of raw materials as shown in Table 2. The physical properties of Block Polymers 2 to 6 are shown in Table 2.

<Synthesis of Amorphous Vinyl Resin 1>

| | |
|---|---|
| Styrene | 75.0 mass parts |
| n-butyl acrylate | 25.0 mass parts |
| β-carboxyethyl acrylate | 3.0 mass parts |

-continued

| | |
|---|---|
| Azobismethoxydimethylvaleronitrile | 0.3 mass parts |
| Normal hexane | 80.0 mass parts |

The above-mentioned raw materials were charged into a beaker and mixed by stirring at 20° C. to prepare a monomer solution, followed by introducing into a heat-dried dropping funnel. Separate from the above, 900.0 mass parts of normal hexane were charged into a heat-dried two-mouth flask. After replacing the air inside the flask with nitrogen, the dropping funnel was attached and the monomer solution was dropped in over the course of 1 hour at 40° C. while sealing the flask. Following completion of dropping, stirring of the mixture was continued for 3 hours, a mixture consisting of 0.3 mass parts of azobismethoxydimethylvaleronitrile and 80.0 mass parts of normal hexane was again dropped in, and the mixture was stirred for 3 hours at 40° C. The hexane was then removed to obtain Amorphous Vinyl Resin 1 (Mn=13400, Mw=24500, Tg=68° C.)

<Synthesis of Amorphous Vinyl Resin 2>

| | |
|---|---|
| Styrene | 95.6 mass parts |
| n-butyl acrylate | 1.0 mass parts |
| Methacrylic acid | 1.7 mass parts |
| Methyl methacrylate | 1.7 mass parts |
| Xylene | 100.0 mass parts |

The above-mentioned raw materials were placed in a four-mouth flask equipped with a thermometer, stirrer, reflux condenser and nitrogen gas inlet tube, the temperature was gradually raised while allowing nitrogen gas to flow into the four-mouth flask and stirring, and 0.5 mass parts of polymerization initiator in the form of Perbutyl D (NOF Corp.) were dropped in at 100° C. followed by raising the temperature to 200° C. and allowing to react for 5 hours.

Subsequently, the temperature was lowered to 100° C. followed by the addition of:

| | |
|---|---|
| styrene | 9.6 mass parts |
| n-butyl acrylate | 0.1 mass parts |
| methacrylic acid | 0.3 mass parts |
| methyl methacrylate | 0.2 mass parts, |

dropping in 0.1 mass parts of additional initiator in the form of Perbutyl D (NOF Corp.), raising the temperature to 200° C. and allowing to react for 5 hours to obtain a styrene-methacrylic acid-methyl methacrylate copolymer in the form of Amorphous Vinyl Resin 2 (Mn=7700, Mw=15000, Tg=92° C.)

<Synthesis of Amorphous Polyester Resin 1>

The following raw materials:

| | |
|---|---|
| terephthalic acid | 17.2 mass parts |
| bisphenol A 2 mole propylene oxide adduct | 76.6 mass parts |
| titanium dihydroxybis (triethanolaminate) | 0.2 mass parts |

were added to a reaction tank equipped with a cooling tube, stirrer and nitrogen inlet tube followed by heating to 220° C. in the presence of flowing nitrogen and allowing to react for 10 hours.

Moreover, 6.1 mass parts of trimellitic anhydride were added followed by heating to 180° C. and allowing to react for 2 hours to obtain Amorphous Polyester Resin 1 (Mn=6000, Mw=10300, Tg=62° C.).

<Synthesis of Amorphous Polyester Resin 2>

| | |
|---|---|
| Terephthalic acid | 166.0 mass parts |
| Trimellitic anhydride | 12.6 mass parts |
| Bisphenol A 2 mole ethylene oxide adduct | 43.2 mass parts |
| Ethylene glycol | 60.0 mass parts |

The above-mentioned monomers and dibutyltin oxide were added at 0.03 mass parts with respect to all acid components and allowed to react for 10 hours while stirring at 220° C. in the presence of flowing nitrogen to obtain Amorphous Polyester Resin 2 (Mn=8700, Mw=14800, Tg=78° C.).

<Synthesis of Amorphous Polyester Resin 3>

| | |
|---|---|
| Terephthalic acid | 166.0 mass parts |
| Bisphenol A 2 mole propylene oxide adduct | 252.8 mass parts |
| Bisphenol A 3 mole propylene oxide adduct | 72.2 mass parts |
| Titanium-based catalyst (titanium dihydroxybis (triethanolaminate)) | 0.25 mass parts |

The above-mentioned materials were added to a reaction tank equipped with a cooling tube, stirrer and nitrogen inlet tube and allowed to react for 10 hours while stirring at 230° C. in the presence of flowing nitrogen to obtain Amorphous Polyester Resin 3 (Mn=5700, Mw=12800, Tg=63° C.)

<Preparation of Binder Resin Solutions 1 to 6>

100.0 mass parts of acetone and 100.0 mass parts of Block Polymer 1 were placed in a beaker equipped with a stirring device followed by continuing to stir at a temperature of 40° C. until the Block Polymer 1 completely dissolved to prepare Binder Resin Solution 1. Binder Resin Solutions 2 to 6 were prepared in the same manner as preparation of Binder Resin Solution 1 with the exception of changing Block Polymer 1 to Block Polymers 2 to 6, respectively.

<Preparation of Binder Resin Solution 7>

Binder Resin Solution 7 was prepared in the same manner as preparation of Binder Resin Solution 1 with the exception of changing Block Polymer 1 to Amorphous Polyester Resin 2.

<Preparation of Binder Resin Solution 8>

Binder Resin Solution 8 was prepared in the same manner as preparation of Binder Resin Solution 1 with the exception of changing Block Polymer 1 to Crystalline Polyester Resin 1.

<Preparation of Binder Resin Fine Particle Dispersion A-1>

50.0 mass parts of Block Polymer 1 were dissolved in 200.0 mass parts of tetrahydrofuran followed by the addition of 3.0 mass parts of anionic surfactant (sodium dodecylbenzene sulfonate) together with 200.0 mass parts of ion exchange water. After heating to 40° C. and stirring for 10 minutes at 8000 rpm using an emulsifier (Ultra-Turrax T-50, IKA Japan K.K.), the tetrahydrofuran was evaporated to prepare Binder Resin Fine Particle Dispersion A-1. The solid concentration was 20.0% and the particle diameter was 100 nm.

<Preparation of Binder Resin Fine Particle Dispersions A-2 and A-3>

Binder Resin Fine Particle Dispersions A-2 and A-3 were prepared in the same manner as preparation of Binder Resin Fine Particle Dispersion A-1 with the exception of changing the Block Polymer 1 to Amorphous Vinyl Resins 1 and 2. The solid concentration of the Binder Resin Fine Particle Dispersion A-2 was 20.0% and the particle diameter was 110 nm. In addition, the solid concentration of the Binder Resin Fine Particle Dispersion A-3 was 20.0% and the particle diameter was 100 nm.

<Preparation of Resin Fine Particle Dispersion B-1>

| | |
|---|---|
| Styrene | 70.0 mass parts |
| Methacrylic acid | 15.0 mass parts |
| Vinyl-modified organic polysiloxane (X-22-2475, Shin-Etsu Chemical Co., Ltd.) | 15.0 mass parts |
| Normal hexane | 80.0 mass parts |

The above-mentioned materials were charged into a beaker and mixed by stirring at 20° C. to prepare a monomer solution followed by introducing into a preliminarily heat-dried dropping funnel. Separate from the above, 740.0 mass parts of normal hexane were charged into a heat-dried two-mouth flask. After replacing the air inside the flask with nitrogen, the dropping funnel was attached and the monomer solution was dropped in over the course of 1 hour at 40° C. while sealing the flask. Following completion of dropping, stirring of the mixture was continued for 3 hours, a mixture consisting of 0.3 mass parts of azobismethoxydimethylvaleronitrile and 80.0 mass parts of normal hexane was again dropped in, and the mixture was stirred for 3 hours at 40° C. Resin Fine Particle Dispersion B-1 was obtained as a result thereof. The solid concentration of the Resin Fine Particle Dispersion B-1 was 10.0% and the particle diameter was 90 nm.

<Preparation of Wax Dispersion 1>

| | |
|---|---|
| Ester wax (dipentaerythritol palmitic acid ester) | 17.0 mass parts |
| Wax dispersant (Polymer obtained by copolymerizing 50.0 mass parts of styrene, 25.0 mass parts of n-butyl acrylate and 10.0 mass parts of acrylonitrile in the presence of 15.0 mass parts of polyethylene, peak molecular weight: 8,500) | 8.0 mass parts |
| Acetone | 75.0 mass parts |

The above-mentioned materials were placed in a glass beaker (Iwaki Glass Co., Ltd.) equipped with a rotor, and the wax was dissolved in the acetone by heating the reaction system to 50° C.

Next, the reaction system was gradually cooled while gently stirring at 50 rpm and cooled to 25° C. over the course of 3 hours to obtain a milky white liquid.

This solution was placed in a heat-resistant container along with 20.0 mass parts of 1 mm glass beads followed by dispersing for 3 hours with a paint shaker (Toyo Seiki Co., Ltd.) to obtain Wax Dispersion 1.

The wax particle diameter and wax melting point are shown in Table 3.

TABLE 3

| Wax dispersion | Type | Melting point (° C.) | Solid concentration (%) | Volume-average particle diameter (nm) |
|---|---|---|---|---|
| 1 | Dipentaerythritol palmitic acid ester | 72 | 25 | 150 |
| 2 | Paraffin wax FT-105 | 104 | 25 | 160 |
| 3 | Dipentaerythritol palmitic acid ester | 72 | 25 | 200 |

<Preparation of Wax Dispersion 2>

Wax Dispersion 2 was prepared in the same manner as Wax Dispersion 1 with the exception of changing the type of wax to the wax (paraffin wax FT-105, Nippon Seiro Co., Ltd.) shown in Table 3. The wax particle diameter and wax melting point are shown in Table 3.

<Preparation of Wax Dispersion 3>

| | |
|---|---|
| Dipentaerythritol palmitic acid ester wax | 30.0 mass parts |
| Neogen RK cationic surfactant (Dai-ichi Kogyo Seiyaku Co., Ltd.) | 5.0 mass parts |
| Ion exchange water | 90.0 mass parts |

The above-mentioned materials were mixed and heated to 95° C., and after adequately dispersing with the Ultra-Turrax T50 (IKA Japan K.K.), the mixture was subjected to dispersion treatment with a pressure discharge-type Gaulin homogenizer to obtain Wax Dispersion 3 having a volume-average particle diameter of 200 nm. The wax particle diameter and wax melting point are shown in Table 3.

<Preparation of Colorant Dispersion 1>

| | |
|---|---|
| C.I. Pigment Blue 15:3 | 100.0 mass parts |
| Acetone | 150.0 mass parts |
| Glass beads (1 mm) | 200.0 mass parts |

The above-mentioned materials were placed in a heat-resistant glass container, and after dispersing for 5 hours with a paint shaker, the glass beads were removed with a Nylon mesh to obtain Colorant Dispersion 1. The solid concentration was 40%.

<Preparation of Colorant Dispersion 2>

| | |
|---|---|
| C.I. Pigment Blue 15:3 | 45.0 mass parts |
| Neogen RK ionic surfactant (Dai-ichi Kogyo Seiyaku Co., Ltd.) | 5.0 mass parts |
| Ion exchange water | 200.0 mass parts |

The above-mentioned materials were placed in a heat-resistant glass container, and after dispersing for hours with a paint shaker, the glass beads were removed with a Nylon mesh to obtain Colorant Dispersion 2. The solid concentration was 20%.

<Untreated Toner Particle Production Example 1>

Figure 3:
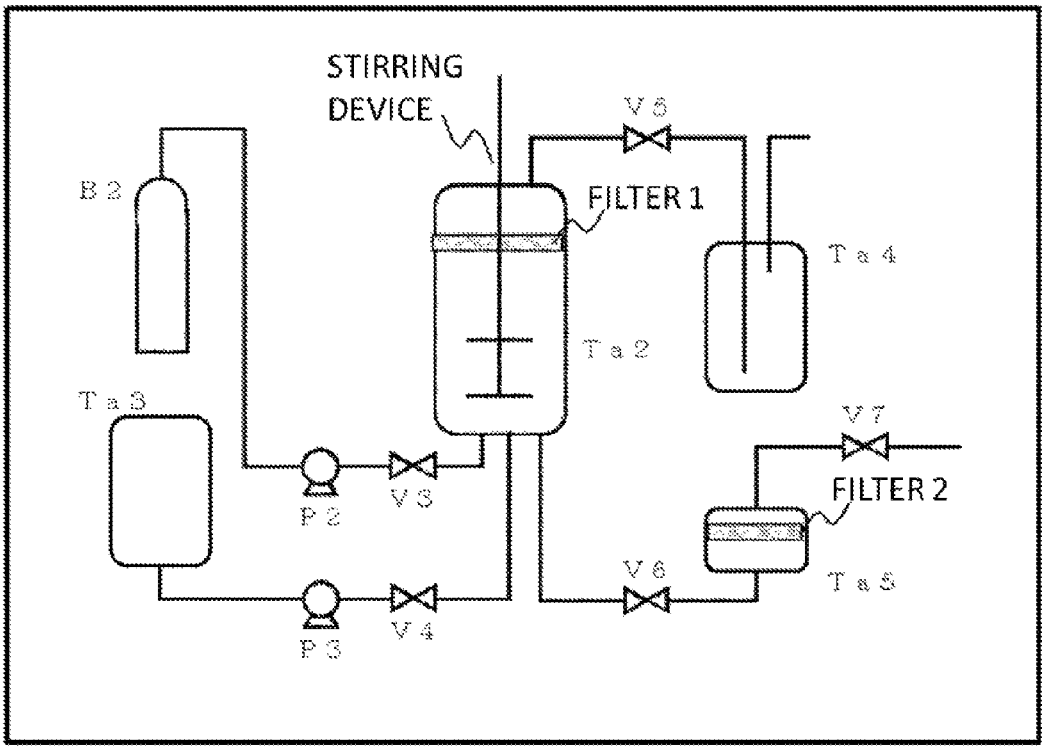
FIG. 3 is a schematic diagram showing an example of a toner production device.

In the device shown in FIG. 3, valves V3 and V4 and pressure regulating valve V5 were first closed, 35.0 mass parts of Resin Fine Particle Dispersion B-1 were charged into a pressure-resistant granulation tank Ta2 equipped with a stirring mechanism and a filter 1 for capturing toner particles, and the internal temperature was adjusted to 25° C. Next, the valve V3 was opened and carbon dioxide (purity: 99.99%) was introduced into the granulation tank Ta2 from a tank B2 using a pump P2, and the valve V3 was closed when the internal pressure reached 3.0 MPa.

On the other hand, the following materials were charged into a resin solution tank Ta3:

| | |
|---|---|
| Binder Resin Solution 1 | 173.0 mass parts |
| Wax Dispersion 1 | 30.0 mass parts |
| Colorant Dispersion 1 | 15.0 mass parts |
| acetone | 15.0 mass parts |
| carbon dioxide | 240.0 mass parts |

followed by adjusting the internal temperature to 25° C.

Next, the valve V4 was opened, and the contents of the resin solution tank Ta3 were introduced into the granulation tank Ta2 using a pump P3 while stirring the inside of the granulation tank Ta2 at a rotating speed of 1000 rpm, followed by closing the valve V4 after the entire content had been introduced. The internal pressure of the granulation tank Ta2 following introduction was 5.0 MPa. The mass of the carbon dioxide introduced was measured using a mass flow meter.

Following completion of introduction of the contents of the resin solution tank Ta3 into the granulation tank Ta2, granulation was carried out by stirring for 10 minutes at a rotating speed of 2000 rpm.

Next, the valve V3 was opened and carbon dioxide was introduced into the granulation tank Ta2 from the tank B2 using the pump P2. At this time, the pressure regulating valve V5 was set to 10.0 MPa, and carbon dioxide was circulated while holding the internal pressure of the granulation tank Ta2 at 10.0 MPa. As a result of this operation, carbon dioxide containing organic solvent (mainly acetone) extracted from liquid droplets following granulation was discharged to a solvent recovery tank Ta4 to separate the organic solvent from the carbon dioxide.

Introduction of carbon dioxide into the granulation tank Ta2 was discontinued at the point the amount of carbon dioxide reached an amount equal to 15 times the mass of carbon dioxide initially introduced into the granulation tank Ta2. The operation of replacing carbon dioxide containing organic solvent with carbon dioxide not containing organic solvent was completed at this point.

Here, a valve V6 was opened and a portion of the toner particles and carbon dioxide in the granulation tank Ta2 was allowed to flow into a sampling tank Ta5 at atmospheric pressure. The valve V6 was closed at the point the pressure in the sampling tank Ta5 and the granulation tank Ta2 equilibrated and toner particles and carbon dioxide no longer flowed into the granulation tank Ta2.

Moreover, as a result of opening a pressure regulating valve V7 a little at a time and reducing the internal pressure of the sampling tank Ta5 to atmospheric pressure, "Untreated Toner Particles 1" were recovered as a result of being captured by a filter 2. The peak temperature Tp1 and onset temperature Tp2 of the maximum endothermic peak derived from resin capable of forming a crystalline structure of the resulting Untreated Toner Particles 1 are shown in Table 5.

<Untreated Toner Particle Production Examples 2 to 9>

Untreated Toner Particles 2 to 9 were obtained in the same manner as in Untreated Toner Particle Production Method 1 with the exception of changing the charged amounts of each raw material, excluding acetone and carbon dioxide, to those shown in Table 4. The peak temperatures Tp1 and onset temperatures Tp2 of the maximum endothermic peaks derived from resins capable of forming a crystalline structure of the resulting Untreated Toner Particles 2 to 9 are shown in Table 5.

TABLE 4

| | Binder resin solution | | Wax dispersion | | | Colorant dispersion | |
|---|---|---|---|---|---|---|---|
| | Material used | Amount of liquid (mass parts) | Material used | Amount of liquid (mass parts) | Amount of wax (mass parts) | Material used | Amount of liquid (mass parts) |
| Untreated Toner Particles 1 | Solution 1 | 173.0 | Dispersion 1 | 30.0 | 7.5 | Dispersion 1 | 15.0 |
| Untreated Toner Particles 2 | Solution 2 | 173.0 | Dispersion 2 | 30.0 | 7.5 | Dispersion 1 | 15.0 |
| Untreated Toner Particles 3 | Solution 3 | 173.0 | Dispersion 2 | 30.0 | 7.5 | Dispersion 1 | 15.0 |
| Untreated Toner Particles 4 | Solution 4 | 173.0 | Dispersion 1 | 30.0 | 7.5 | Dispersion 1 | 15.0 |
| Untreated Toner Particles 5 | Solution 5 | 173.0 | Dispersion 1 | 30.0 | 7.5 | Dispersion 1 | 15.0 |
| Untreated Toner Particles 6 | Solution 6 | 173.0 | Dispersion 1 | 30.0 | 7.5 | Dispersion 1 | 15.0 |
| Untreated Toner Particles 7 | Solution 1<br>Solution 7 | 43.3<br>129.7 | Dispersion 1 | 30.0 | 7.5 | Dispersion 1 | 15.0 |
| Untreated Toner Particles 8 | Solution 7<br>Solution 8 | 138.4<br>34.6 | Dispersion 1 | 30.0 | 7.5 | Dispersion 1 | 15.0 |
| Untreated Toner Particles 9 | Solution 7<br>Solution 8 | 121.1<br>51.9 | Dispersion 1 | 30.0 | 7.5 | Dispersion 1 | 15.0 |

TABLE 5

| Untreated Toner Particles | Maximum endothermic peak derived from resin capable of forming crystalline structure: Peak temperature Tp1 (° C.) | Onset temperature Tp2 (° C.) |
|---|---|---|
| 1 | 60 | 40 |
| 2 | 88 | 68 |
| 3 | 78 | 47 |
| 4 | 55 | 34 |
| 5 | 60 | 40 |
| 6 | 60 | 40 |
| 7 | 59 | 39 |
| 8 | 65 | 43 |
| 9 | 65 | 43 |
| 10 | 60 | 40 |
| 11 | 60 | 40 |
| 12 | 64 | 44 |
| 13 | 57 | 37 |
| 14 | 63 | 43 |

<Untreated Toner Particle Production Example 10>

(Preparation of Oily Phase)

| | |
|---|---|
| Block Polymer 1 | 100.0 mass parts |
| 1-butanone | 85.0 mass parts |

The above-mentioned materials were placed in a beaker and stirred for 1 minute at 3000 rpm using a Disper (Tokushu Kika Kogyo Co., Ltd.).

| | |
|---|---|
| Wax Dispersion 1 | 50.0 mass parts |
| Colorant Dispersion 1 | 25.0 mass parts |
| 1-butanone | 5.0 mass parts |

Moreover, the above-mentioned materials were placed in a beaker and stirred for 3 minutes at 6000 rpm using a Disper (Tokushu Kika Kogyo Co., Ltd.) to prepare an oily phase.

(Preparation of Aqueous Phase)

| | |
|---|---|
| Binder Resin Fine Particle Dispersion A-3 | 35.0 mass parts |
| 50% aqueous solution of sodium dodecyl diphenyl ether disulfonate (Eleminol MON-7, Sanyo Chemical Co., Ltd.) | 30.0 mass parts |
| 1% by mass aqueous solution of carboxymethyl cellulose | 100.0 mass parts |
| Ion exchange water | 400.0 mass parts |
| 1-butanone | 50.0 mass parts |

The above-mentioned materials were placed in a container and stirred for 1 minute at 5000 rpm using a TK Homomixer (Tokushu Kika Kogyo Co., Ltd.) to prepare an aqueous phase.

(Granulating Step)

The oily phase was added to the aqueous phase followed by increasing the rotating speed of the TK Homomixer to 10000 rpm and continuing to stir for 1 minute to suspend the oily phase in water and obtain a suspension. This suspension was stirred for 30 minutes at 50 rpm using an impeller followed by transferring to a 2 L eggplant-shaped flask. Nitrogen gas was blown onto the liquid surface for 1 hour at a flow rate of 10 L/min while rotating at 30 rpm using a 25° C. water bath and rotary evaporator to obtain an aqueous dispersion of untreated toner particles.

(Washing Step to Drying Step)

Hydrochloric acid was added to the toner particle aqueous dispersion until the pH reached 1.5, followed by filtering after stirring for 30 minutes and repeating a procedure consisting of filtering and re-dispersing in ion exchange water until the electrical conductivity of the slurry was 100 μS. Surfactant remaining in the slurry obtained in this manner was then removed to obtain a filter cake of toner particles. The above-mentioned filter cake was dried for 3 days at normal temperature with a vacuum dryer and sized with a mesh having openings of 75 μm to obtain Untreated Toner Particles 10. The peak temperature Tp1 and onset temperature Tp2 of the maximum endothermic peak derived from resin capable of forming a crystalline structure of the resulting Untreated Toner Particles 10 are shown in Table 5.

<Untreated Toner Particle Production Example 11>

| | |
|---|---|
| Binder Resin Fine Particle Dispersion A-1 | 83.3 mass parts |
| Binder Resin Fine Particle Dispersion A-2 | 116.7 mass parts |
| Colorant Dispersion 2 | 30.0 mass parts |
| Wax Dispersion 3 | 30.0 mass parts |
| 10% by mass aqueous polyaluminum chloride solution | 1.5 mass parts |

The above-mentioned materials were mixed in a round, stainless steel flask and mixed and dispersed with the Ultra-Turrax T50 (IKA Japan K.K.) followed by holding at 45° C. for 60 minutes while stirring. Subsequently, after slowly adding 77.0 mass parts of Binder Resin Dispersion A-3 and adjusting the pH in the reaction system to 6 with 0.5 mol/L aqueous sodium hydroxide solution, the stainless steel flask was sealed and heated to 96° C. while continuing to stir using a magnetic seal. Aqueous sodium hydroxide solution was suitably added during the time the temperature rose to prevent the pH from falling below 5.5. Subsequently, the temperature was held at 96° C. for 5 hours.

Following completion of the reaction, the reaction mixture was cooled, filtered and adequately washed with ion exchange water followed by subjecting to solid-liquid separation by Nutsche suction filtration. This was further re-dispersed in 3 L of ion exchange water followed by stirring for 15 minutes at 300 rpm and washing. This procedure was further repeated 5 times, and solid-liquid separation was carried out by Nutsche suction filtration using No. 5A filter paper when the pH of the filtrate reached 7.0. Next, vacuum drying was continued for 12 hours to obtain Untreated Toner Particles 11. The peak temperature Tp1 and onset temperature Tp2 of the maximum endothermic peak derived from resin capable of forming a crystalline structure of the resulting Untreated Toner Particles 11 are shown in Table 5.

<Untreated Toner Particle Production Example 12>

(Preparation of Aqueous Phase)

9.0 mass parts of tricalcium phosphate were added to 1300.0 mass parts of ion exchange water heated to 60° C. followed by stirring at 10000 r/min using a TK Homomixer (Tokushu Kika Kogyo Co., Ltd.) to prepare an aqueous medium.

(Preparation of Oily Phase)

In addition, the following materials were dissolved at 100 r/min with a propeller-type stirring device to prepare a solution.

| | |
|---|---|
| Styrene | 65.0 mass parts |
| n-butyl acrylate | 15.0 mass parts |
| Divinylbenzene | 0.2 mass parts |
| Crystalline Polyester Resin 1 | 20.0 mass parts |
| Next, the following materials: | |
| copper phthalocyanine | 7.0 mass parts |
| charge control agent (TN105, (Hodogaya Chemical Co., Ltd. ) | 1.0 mass part |
| dipentaerythritol palmitic acid ester (melting point: 72° C.) | 15.0 mass parts |

were added to the above-mentioned solution followed by dissolving and dispersing by stirring at 9,000 r/min with a TK Homomixer (Tokushu Kika Kogyo Co., Ltd.) after heating the mixed liquid to a temperature of 60° C.

8.0 mass parts of polymerization initiator (t-butyl peroxypivalate) were dissolved therein to prepare a polymerizable monomer composition.

The above-mentioned polymerizable monomer composition was added to the above-mentioned aqueous medium followed by granulating by stirring at 60° C. for 30 minutes at 10000 r/min using a TK Homomixer.

Subsequently, after transferring to a propeller-type stirring device and allowing to react for 2 hours at 70° C. in a nitrogen atmosphere at a dissolved oxygen concentration of 0.50% or less while stirring at 100 rpm, the reaction mixture was heated to 80° C. and allowed to further react for 2 hours.

Subsequently, a solution obtained by mixing 0.5 mass parts of Amorphous Polyester Resin 3 with 3.0 mass parts of styrene monomer was dropped in over the course of 1 hour. Subsequently, 1.0 mass part of potassium persulfate was added followed by heating to 80° C. in a nitrogen atmosphere at a dissolved oxygen concentration of 0.50% or less and further allowing to react for 4 hours to produce toner particles. Following completion of the polymerization reaction, the slurry containing the particles was cooled, tricalcium phosphate was dissolved by adding hydrochloric acid, and the slurry was washed with 10 volumes of water followed by filtering, washing twice with water and drying to obtain Untreated Toner Particles 12. The peak temperature Tp1 and onset temperature Tp2 of the maximum endothermic peak derived from resin capable of forming a crystalline structure of the resulting Untreated Toner Particles 12 are shown in Table 5.

<Untreated Toner Particle Production Method 13>

(Preparation of Aqueous Phase)

9.0 mass parts of tricalcium phosphate were added to 1300.0 mass parts of ion exchange water heated to 60° C. followed by stirring at 10000 r/min using a TK Homomixer (Tokushu Kika Kogyo Co., Ltd.) to prepare an aqueous medium.

(Preparation of Oily Phase)

In addition, the following materials were dissolved at 100 r/min with a propeller-type stirring device to prepare a solution.

| | |
|---|---|
| Styrene | 60.0 mass parts |
| n-butyl acrylate | 10.0 mass parts |
| Divinylbenzene | 0.2 mass parts |
| Behenyl acrylate | 30.0 mass parts |
| Next, the following materials: | |
| copper phthalocyanine | 7.0 mass parts |
| charge control agent (TN105, (Hodogaya Chemical Co., Ltd.) | 1.0 mass part |
| dipentaerythritol palmitic acid ester (melting point: 72° C.) | 15.0 mass parts |

were added to the above-mentioned solution followed by dissolving and dispersing by stirring at 9,000 r/min with a TK Homomixer (Tokushu Kika Kogyo Co., Ltd.) after heating the mixed liquid to a temperature of 60° C.

8.0 mass parts of polymerization initiator (t-butyl peroxypivalate) were dissolved therein to prepare a polymerizable monomer composition.

The above-mentioned polymerizable monomer composition was added to the above-mentioned aqueous medium followed by granulating by stirring at 60° C. for 30 minutes at 10000 r/min using a TK Homomixer.

Subsequently, after transferring to a propeller-type stirring device and allowing to react for 2 hours at 70° C. in a nitrogen atmosphere at a dissolved oxygen concentration of 0.50% or less while stirring at 100 rpm, the reaction mixture was heated to 80° C. and allowed to further react for 2 hours.

Subsequently, a solution obtained by mixing 0.5 mass parts of Amorphous Polyester Resin 3 with 3.0 mass parts of styrene monomer was dropped in over the course of 1 hour. Subsequently, 1.0 mass part of potassium persulfate was added followed by heating to 80° C. in a nitrogen atmosphere at a dissolved oxygen concentration of 0.50% or less and further allowing to react for 4 hours to produce toner particles.

Following completion of the polymerization reaction, the slurry containing the particles was cooled, tricalcium phosphate was dissolved by adding hydrochloric acid, and the slurry was washed with 10 volumes of water followed by filtering, washing twice with water and drying to obtain Untreated Toner Particles 13. The peak temperature Tp1 and onset temperature Tp2 of the maximum endothermic peak derived from resin capable of forming a crystalline structure of the resulting Untreated Toner Particles 13 are shown in Table 5.

<Untreated Toner Particle Production Method 14>

| | |
|---|---|
| Amorphous Polyester Resin 1 | 7.0 mass parts |
| Amorphous Polyester Resin 2 | 68.0 mass parts |
| Block Polymer 1 | 25.0 mass parts |
| Dipentaerythritol palmitic acid ester (melting point: 72° C.) | 5.0 mass parts |
| C.I. Pigment Blue 15:3 | 4.0 mass parts |
| Aluminum 3,5-di-t-butylsalicylate compound | 0.5 mass parts |

The above-mentioned materials were mixed well with a Henschel mixer (Model FM-75, Mitsui Mining Co., Ltd.) followed by melting and kneading with a twin-screw extruder (Model PCM-30, Ikegai Co., Ltd.) set to 120° C. The resulting kneaded product was cooled and coarsely pulverized to 1 mm or less with a hammer mill to obtain a coarsely pulverized product.

Next, the resulting coarsely pulverized product was pulverized using a turbo mill (T-250, RSS rotor/SNB liner, Freund-Turbo Corp.) to obtain a pulverized product having a particle diameter of 5.8 μm.

Next, the resulting pulverized product was sized using a particle design system (Faculty System, Hosokawa Micron Ltd.) in which the shape and number of hammers had been modified to obtain Untreated Toner Particles 14. The peak temperature Tp1 and onset temperature Tp2 of the maximum endothermic peak derived from resin capable of forming a crystalline structure of the resulting Untreated Toner Particles 14 are shown in Table 5.

Example 1

Pressurized annealing was subsequently carried out in Untreated Toner Particle Production Method 1 with the untreated toner particles and carbon dioxide remaining in the granulation tank Ta2 of the device shown in FIG. 3.

The internal temperature of the granulation tank Ta2 was adjusted to a temperature of 35° C., and the valve V3 was opened to introduce carbon dioxide (purity: 99.99%) into the granulation tank Ta2 from the tank B2 using the pump P2 while stirring at 150 rpm, followed by raising the pressure to 10.0 MPa. When the pressure reached 10 MPa, the pump P2 was stopped and the valve V3 was closed followed by holding at that pressure for 30 minutes. After 30 minutes had elapsed, the pressure regulating valve V5 was opened and carbon dioxide was discharged outside the granulation tank Ta2 followed by reducing the pressure of the tank Ta2 to atmospheric pressure. After discontinuing stirring, the granulation tank Ta2 was opened to obtain "Treated Toner Particles 1" that had undergone pressurized annealing treatment.

1.8 mass parts of hydrophobic silica fine powder treated with hexamethyldisilazane (number-average primary particle diameter: 7 nm) and 0.15 mass parts of rutile titanium dioxide fine powder (number-average primary particle diameter: 30 nm) were dry-mixed for 5 minutes with 100.0 mass parts of the Treated Toner Particles 1 that had undergone pressurized annealing treatment with a Henschel mixer (Mitsui Mining Co., Ltd.) to obtain Toner 1.

TABLE 6

| | | Untreated Toner particles | Onset temperature Tp2 (° C.) | Retention temperature T1 (° C.) | Retention pressure (MPa) | Retention time (min) | Medium used as main component |
|---|---|---|---|---|---|---|---|
| Examples | Toner 1 | 1 | 40 | 35 | 10.0 | 30 | Supercritical carbon dioxide |
| | Toner 2 | 2 | 68 | 55 | 10.0 | 30 | Supercritical carbon dioxide |
| | Toner 3 | 3 | 47 | 45 | 10.0 | 30 | Supercritical carbon dioxide |
| | Toner 4 | 4 | 34 | 30 | 10.0 | 30 | Liquid carbon dioxide |
| | Toner 5 | 1 | 40 | 32 | 10.0 | 30 | Supercritical carbon dioxide |
| | Toner 6 | 1 | 40 | 35 | 15.0 | 30 | Supercritical carbon dioxide |
| | Toner 7 | 1 | 40 | 35 | 20.0 | 30 | Supercritical carbon dioxide |
| | Toner 8 | 1 | 40 | 35 | 8.0 | 30 | Supercritical carbon dioxide |
| | Toner 9 | 1 | 40 | 35 | 5.0 | 30 | Gaseous carbon dioxide |
| | Toner 10 | 1 | 40 | 35 | 10.0 | 240 | Supercritical carbon dioxide |
| | Toner 11 | 1 | 40 | 35 | 10.0 | 10 | Supercritical carbon dioxide |
| | Toner 12 | 1 | 40 | 25 | 10.0 | 120 | Liquid carbon dioxide |
| | Toner 13 | 1 | 40 | 20 | 10.0 | 120 | Liquid carbon dioxide |
| | Toner 14 | 1 | 40 | 25 | 10.0 | 240 | Liquid carbon dioxide |
| | Toner 15 | 1 | 40 | 35 | 3.0 | 120 | Gaseous carbon dioxide |
| | Toner 16 | 1 | 40 | 35 | 3.0 | 240 | Gaseous carbon dioxide |
| | Toner 17 | 4 | 34 | 30 | 3.0 | 10 | Gaseous carbon dioxide |
| | Toner 18 | 4 | 34 | 20 | 2.0 | 5 | Gaseous carbon dioxide |
| | Toner 19 | 5 | 40 | 35 | 10.0 | 30 | Supercritical carbon dioxide |
| | Toner 20 | 6 | 40 | 35 | 10.0 | 30 | Supercritical carbon dioxide |
| | Toner 21 | 7 | 39 | 35 | 10.0 | 30 | Supercritical carbon dioxide |
| | Toner 22 | 8 | 43 | 38 | 10.0 | 30 | Supercritical carbon dioxide |
| | Toner 23 | 9 | 43 | 38 | 10.0 | 30 | Supercritical carbon dioxide |
| | Toner 24 | 10 | 40 | 35 | 10.0 | 30 | Supercritical carbon dioxide |
| | Toner 25 | 11 | 40 | 35 | 10.0 | 30 | Supercritical carbon dioxide |
| | Toner 26 | 12 | 44 | 35 | 10.0 | 30 | Supercritical carbon dioxide |
| | Toner 27 | 13 | 37 | 35 | 10.0 | 30 | Supercritical carbon dioxide |
| | Toner 28 | 14 | 43 | 35 | 10.0 | 30 | Supercritical carbon dioxide |
| Comparative Examples | Toner 29 | 1 | 40 | 42 | 10.0 | 30 | Supercritical carbon dioxide |
| | Toner 30 | 1 | 40 | 10 | 10.0 | 30 | Liquid carbon dioxide |
| | Toner 31 | 1 | 40 | 35 | 1.0 | 30 | Gaseous carbon dioxide |
| | Toner 32 | 1 | 40 | — | — | — | — |
| | Toner 33 | 1 | 40 | 35 | — | 240 | Air |
| | Toner 34 | 1 | 40 | 35 | — | 720 | Air |
| | Toner 35 | 1 | 40 | 50 | — | 240 | Air |
| | Toner 36 | 1 | 40 | 50 | — | 720 | Air |

Examples 2 to 23

Toners 2 to 23 subjected to pressurized annealing treatment were obtained in the same manner as Example 1 with the exception of changing the untreated toner particles, retention pressure, retention temperature and retention time in Example 1 to the conditions shown in Table 6.

However, in the case the pressure of the granulation tank Ta2 prior to pressurized annealing treatment was higher than the retention pressure of pressurized annealing treatment, the pressure regulating valve V5 was opened and retention pressure was adjusted to the prescribed retention pressure by discharging carbon dioxide outside the granulation tank Ta2.

Example 24

The valves V1 and V2 in the device shown in FIG. 2 were closed, the Toner Particles 10 were placed in the Tank Ta1 adjusted to an internal temperature of 35° C., and the tank Ta1 was sealed. The valve V1 was opened to introduce carbon dioxide (purity: 99.99%) into the tank Ta1 from the tank B1 using the pump P1 while stirring at 150 rpm, followed by raising the pressure to 10.0 MPa. When the pressure reached 10 MPa, the pump P1 was stopped and the valve V1 was closed followed by holding at that pressure for 30 minutes. After 30 minutes had elapsed, the valve V2 was opened and carbon dioxide was discharged outside the tank Ta1 followed by reducing the pressure of the tank Ta1 to atmospheric pressure. After discontinuing stirring, the tank Ta1 was opened to obtain "Treated Toner Particles 10" that had undergone pressurized annealing treatment.

1.8 mass parts of hydrophobic silica fine powder treated with hexamethyldisilazane (number-average primary particle diameter: 7 nm) and 0.15 mass parts of rutile titanium dioxide fine powder (number-average primary particle diameter: 30 nm) were dry-mixed for 5 minutes with 100.0 mass parts of the Treated Toner Particles 10 that had undergone pressurized annealing treatment with a Henschel mixer (Mitsui Mining Co., Ltd.) to obtain Toner 24.

Examples 25 to 28

Toners 25 to 28 subjected to pressurized annealing treatment were obtained in the same manner as Example 24 with the exception of changing the untreated toner particles, retention pressure, retention temperature and retention time in Example 24 to the conditions shown in Table 6.

Comparative Examples 1 to 3

Toners 29 to 31 were obtained in the same manner as Example 1 with the exception of changing the untreated toner particles, retention pressure, retention temperature and retention time in Example 1 to the conditions shown in Table 6.

Furthermore, since melting and unification of toner particles was confirmed following annealing Toner 29 of the comparative examples, the toner particles were not added externally since their shape was not maintained and the evaluations to be subsequently described were not carried out.

Comparative Example 4

Toner 32 was obtained in the same manner as Example 1 with the exception of not carrying out pressurized annealing treatment on the Untreated Toner Particles 1 in Example 1.

Comparative Examples 5 and 6

Untreated Toner Particles 1 were spread out in a stainless steel vat, and the above-mentioned vat was placed in a constant temperature dryer (41-S5, Satake Chemical Equipment Mfg. Co., Ltd.) adjusted to an internal temperature of 35° C., followed by carrying out annealing treatment at atmospheric pressure under the conditions shown in Table 6 and treating by external addition of hydrophobic silica fine powder and rutile titanium dioxide fine powder in the same manner as Example 1 to obtain Toners 33 and 34.

Comparative Examples 7 and 8

Untreated Toner Particles 1 were spread out in a stainless steel vat, and the above-mentioned vat was placed in a constant temperature dryer (41-S5, Satake Chemical Equipment Mfg. Co., Ltd.) adjusted to an internal temperature of 50° C., followed by carrying out annealing treatment at atmospheric pressure under the conditions shown in Table 6 and treating by external addition of hydrophobic silica fine powder and rutile titanium dioxide fine powder in the same manner as Example 1 to obtain Toners 35 and 36.

<Evaluation Methods>

The toners obtained in this manner were prepared by respectively allowing to stand for 24 hours in a normal temperature and normal humidity environment (23° C., 60% RH) and allowing to stand for 60 days in a harsh environment (40° C., 95% RH), followed by subjecting to the evaluations indicated below. The evaluation results are shown in Table 7.

(Heat-Resistant Storability)

Approximately 10 g of each of the toners allowed to stand for 24 hours in a normal temperature and normal humidity environment (23° C., 60% RH) and each of the toners allowed to stand for 60 days in a harsh environment (40° C., 95% RH) were placed in a 100 ml plastic cup and allowed to stand for 3 days in a constant temperature bath adjusted to 55° C. followed by visual evaluation.

The evaluation criteria used for heat-resistant storability were as indicated below.

A: No aggregates observed at all and in a state similar to the initial state.

B: Slight aggregation that was able to be disrupted by shaking the plastic cup gently about 5 times.

C: Aggregation able to be easily broken up with the fingers.

D: Considerable aggregation of a degree that caused problems in terms of actual use.

E: Completely solidified and unable to be used.

<Evaluation of Low-Temperature Fixability>

A two-component developer was prepared by mixing 8.0 mass parts of the above-mentioned toners with 92.0 mass parts of a carrier (standard carrier of the Imaging Society of Japan, spherical carrier N-01 surface-treated with a ferrite core), and installed in a CLC5000 Color Laser Copier (Canon Inc.). The development contrast of the copier was adjusted so that the amount of toner placed on the paper was 1.2 mg/cm$^2$, and solid unfixed images having a leading margin of 5 mm, width of 100 mm and length of 280 mm were generated in the monochromatic mode in a normal temperature and normal humidity environment (23° C., 60% RH). A4-size heavy paper (plover bond paper, 1.05 g/m$^2$, Fox River Paper Co.) was used for the paper.

Next, the fixing unit of the LBP5900 (Canon Inc.) was manually modified to allow setting of the fixation temperature, and the rotating speed of the fixing unit was changed to 270 mm/s while nip internal pressure was changed to 120 kPa. Fixed images of the above-mentioned solid unfixed images were obtained at various temperatures using the modified fixing unit while raising the temperature over a range from 80° C. to 180° C. in 5° C. increments in a normal temperature and normal humidity environment (23° C., 60% RH).

Soft thin paper (trade name: "Dusper", Ozu Corp.) was placed over the image regions of the resulting fixed images and the image regions were rubbed five times back and forth while applying a load of 4.9 kPa from above the thin paper. Image densities before and after rubbing were respectively measured, and the percentage of decrease in image density ΔD (%) was calculated according to the equation indicated below. The temperature when this value of ΔD (%) was less than 10% was taken to be the fixing onset temperature, and low-temperature fixation was evaluated according to the evaluation criteria indicated below.

Furthermore, image density was measured with a color reflection densitometer (X-Rite 404A, X-Rite Inc.).

$$\Delta D(\%)=(\text{image density before rubbing}-\text{image density after rubbing})/\text{image density before rubbing}\times 100$$

The evaluation criteria used for low-temperature fixability were as indicated below.

A: Fixing onset temperature of 100° C. or lower (particularly superior low-temperature fixability)

B: Fixing onset temperature of higher than 100° C. and 110° C. or lower (superior low-temperature fixability)

C: Fixing onset temperature of higher than 110° C. and 120° C. or lower (level of low-temperature fixability that does not cause problems during use)

D: Fixing onset temperature of higher than 120° C. and 130° C. or lower (somewhat inferior low-temperature fixability)

E: Fixing onset temperature of higher than 130° C. (inferior low-temperature fixability)

TABLE 7

| | | Heat-resistant storability 23° C., 60% RH | Heat-resistant storability 40° C., 95% RH | Low-temperature fixability (° C.) |
|---|---|---|---|---|
| Examples | Toner 1 | A | A | A (100) |
| | Toner 2 | A | A | C (120) |
| | Toner 3 | A | A | B (110) |
| | Toner 4 | B | C | A (100) |
| | Toner 5 | A | B | A (100) |
| | Toner 6 | A | A | A (100) |
| | Toner 7 | A | A | A (100) |
| | Toner 8 | A | B | A (100) |
| | Toner 9 | B | B | A (100) |
| | Toner 10 | A | A | A (100) |
| | Toner 11 | B | C | A (100) |
| | Toner 12 | B | B | A (100) |
| | Toner 13 | B | C | A (100) |
| | Toner 14 | A | B | A (100) |
| | Toner 15 | B | C | A (100) |
| | Toner 16 | B | B | A (100) |
| | Toner 17 | C | C | A (100) |
| | Toner 18 | C | C | A (100) |
| | Toner 19 | A | A | C (120) |

TABLE 7-continued

| | | Heat-resistant storability 23° C., 60% RH | Heat-resistant storability 40° C., 95% RH | Low-temperature fixability (° C.) |
|---|---|---|---|---|
| | Toner 20 | A | A | B (110) |
| | Toner 21 | A | A | C (120) |
| | Toner 22 | A | A | C (120) |
| | Toner 23 | A | A | B (110) |
| | Toner 24 | A | A | A (100) |
| | Toner 25 | A | A | B (110) |
| | Toner 26 | A | A | A (100) |
| | Toner 27 | A | A | B (110) |
| | Toner 28 | A | A | A (100) |
| Comparative Examples | Toner 29 | — | — | — |
| | Toner 30 | C | D | A (100) |
| | Toner 31 | C | D | A (100) |
| | Toner 32 | D | E | A (100) |
| | Toner 33 | D | E | A (100) |
| | Toner 34 | D | E | A (100) |
| | Toner 35 | C | D | A (100) |
| | Toner 36 | A | A | A (100) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-108201, filed May 22, 2013, which is hereby incorporated by reference herein in its entirety.

What is claimed is:

1. A toner production method, comprising:

(i) a step of producing untreated toner particles, each of which comprises a binder resin and a colorant, the binder resin containing a resin (A) capable of forming a crystalline structure; and (ii) a pressure treatment step of obtaining treated toner particles by holding the untreated toner particles for 5 minutes or more in a state in which pressure of 2.0 MPa or more is applied to the untreated toner particles under conditions of a temperature T1 (° C.) defined by formula (1):

$$20 \leq T1 \leq Tp2 \quad (1)$$

(wherein, Tp2 represents an onset temperature (° C.) of the maximum endothermic peak derived from the resin (A) on an endothermic curve during a first temperature rise of the untreated toner particles as determined by differential scanning calorimetric measurement), wherein a peak temperature Tp1 of the maximum endothermic peak derived from the resin (A) on the endothermic curve during the first temperature rise of the untreated toner particles as determined by differential scanning calorimetric measurement is from at least 50° C. to not more than 90° C., and wherein the untreated toner particles are obtained by any one of (I) to (VI):

(I) the untreated toner particles are obtained by performing, a step of obtaining a resin composition by dissolving or dispersing the binder resin comprising the resin (A) and the colorant in an organic solvent able to dissolve the binder resin;

a step of obtaining a dispersion by dispersing the resin composition in a dispersion medium comprising carbon dioxide at from at least 1.0 MPa to not more than 20.0 Mpa;

a step of removing the organic solvent from the dispersion; and a step of reducing a pressure to atmospheric pressure, (II) the untreated toner particles are obtained by performing, a step of obtaining a resin composition by dissolving or dispersing the binder resin comprising the resin (A) and the colorant in an organic solvent able to dissolve the binder resin;

a step of obtaining a dispersion by dispersing the resin composition in an aqueous medium; and a step of removing the organic solvent from the dispersion via the aqueous medium, (III) the untreated toner particles are obtained by performing, a step of obtaining a binder resin fine particle dispersion by dispersing the binder resin comprising the resin (A) in an aqueous medium or an organic solvent that does not dissolve the binder resin;

a step of obtaining a colorant fine particle dispersion by dispersing the colorant in aqueous medium or an organic solvent that does not dissolve the binder resin;

a step of forming aggregated particles by mixing the binder resin fine particle dispersion and the colorant fine particle dispersion; and a step of heating the aggregated particles at a temperature equal to or higher than a melting point or a glass transition temperature of the binder resin to fuse the aggregated particles, (IV) the untreated toner particles are obtained by performing, a step of obtaining a polymerizable monomer composition by mixing a polymerizable monomer, the resin (A) and the colorant;

a step of forming liquid droplets of the polymerizable monomer composition by dispersing the polymerizable monomer composition in an aqueous medium comprising a dispersion stabilizer; and a step of polymerizing the polymerizable monomer comprised in liquid droplets of the polymerizable monomer composition, (V) the untreated toner particles are obtained by performing, a step of obtaining a polymerizable monomer composition by mixing a polymerizable monomer, a polymerizable monomer that is a precursor of the resin (A), and the colorant;

a step of forming liquid droplets of the polymerizable monomer composition by dispersing the polymerizable monomer composition in an aqueous medium comprising a dispersion stabilizer; and a step of polymerizing the polymerizable monomer comprised in the polymerizable monomer composition, and (VI) the untreated toner particles are obtained by performing, a step of obtaining a kneaded product by melting and kneading the binder resin comprising the resin (A) and the colorant; and a step of pulverizing the kneaded product.

2. The toner production method according to claim 1, wherein the pressure treatment step is carried out in a medium having carbon dioxide as a main component.

3. The toner production method according to claim 2, wherein the carbon dioxide is carbon dioxide in a supercritical state.

4. The toner production method according to claim 1, wherein the resin (A) is a resin that comprises segments capable of forming a crystalline structure, and the content of the segments capable of forming a crystalline structure is 30.0 mass % or more based on the total mass of the binder resin.

5. The toner production method according to claim 1, wherein the resin (A) is a block polymer obtained by chemically linking segments capable of forming a crystalline structure and segments incapable of forming a crystalline structure.

6. The toner production method according to claim 4, wherein the segments capable of forming a crystalline structure are obtained by reacting an aliphatic diol having 2 to 20 carbon atoms with an aliphatic dicarboxylic acid having 2 to 20 carbon atoms.

* * * * *